US007713669B2

(12) United States Patent
Mizutani et al.

(10) Patent No.: US 7,713,669 B2
(45) Date of Patent: May 11, 2010

(54) TONER FOR DEVELOPING ELECTROSTATIC IMAGES, ELECTROSTATIC IMAGE DEVELOPER, AND IMAGE-FORMING METHOD

(75) Inventors: Noriyuki Mizutani, Minamiashigara (JP); Hideo Maehata, Minamiashigara (JP); Hirokazu Hamano, Minamiashigara (JP); Hiroyuki Tanaka, Minamiashigara (JP); Moegi Iguchi, Minamiashigara (JP); Soichiro Kitagawa, Minamiashigara (JP); Susumu Yoshino, Minamiashigara (JP); Yuka Ishihara, Minamiashigara (JP); Yosuke Tsurumi, Minamiashigara (JP); Akira Matsumoto, Minamiashigara (JP); Masaru Takahashi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 881 days.

(21) Appl. No.: 11/187,929

(22) Filed: Jul. 25, 2005

(65) Prior Publication Data

US 2006/0204880 A1 Sep. 14, 2006

(30) Foreign Application Priority Data

Mar. 11, 2005 (JP) ..... 2005-070066

(51) Int. Cl.
*G03G 9/087* (2006.01)

(52) U.S. Cl. ..... 430/109.4; 430/111.4

(58) Field of Classification Search ..... 430/109.4, 430/111.4

See application file for complete search history.

(56) References Cited

U.S. PATENT DOCUMENTS

| | | | | |
|---|---|---|---|---|
| 5,057,392 | A * | 10/1991 | McCabe et al. | 430/109.2 |
| 6,395,442 | B1 * | 5/2002 | Hayashi et al. | 430/109.4 |
| 2002/0160294 | A1 * | 10/2002 | Okuno et al. | 430/124 |
| 2003/0180645 | A1 * | 9/2003 | Tavernier et al. | 430/109.4 |

FOREIGN PATENT DOCUMENTS

| | | |
|---|---|---|
| JP | B2 56-13943 | 4/1981 |
| JP | B2 62-39428 | 8/1987 |
| JP | B2 63-25335 | 5/1988 |
| JP | B2 4-30014 | 5/1992 |
| JP | A 2003-50478 | 2/2003 |

* cited by examiner

*Primary Examiner*—Mark F Huff
*Assistant Examiner*—Rachel L Burney
(74) *Attorney, Agent, or Firm*—Oliff & Berridge, PLC

(57) ABSTRACT

A toner for developing electrostatic images, comprising a binder resin and a colorant, the binder resin including a crystalline polyester resin and an amorphous resin. When, in differential scanning calorimetry of the toner according to ASTM D3418-8, the temperature of the endothermic peak derived from the crystalline polyester resin in a first heating process is defined as Tm1 (° C.), the endothermic quantity based on the endothermic peak in the first heating process is defined as ΔH1 (mW/g), and the endothermic quantity based on the endothermic peak in a second heating process is defined as ΔH2 (mW/g), Tm1 is 50 to 80° C., and ΔH1 and ΔH2 satisfy the relationship represented by the following Formula (1). When the softening temperature of the toner is defined as $T_{f1/2}$ (° C.), $Tf_{1/2}$ is 85 to 135° C. Tm1 and $T_{f1/2}$ satisfy the relationship represented by the following Formula (2):

$$0.35 \leqq \Delta H2/\Delta H1 \leqq 0.95 \quad \text{Formula (1)}$$

$$T_{f1/2} \leqq 205-(1.4 \times Tm1) \quad \text{Formula (2).}$$

16 Claims, 2 Drawing Sheets

TONER FOR DEVELOPING ELECTROSTATIC IMAGES, ELECTROSTATIC IMAGE DEVELOPER, AND IMAGE-FORMING METHOD

CROSS-REFERENCE TO RELATED APPLICATION

This application claims priority under 35 USC 119 from Japanese Patent Application No. 2005-070066, the disclosure of which is incorporated by reference herein.

BACKGROUND OF THE INVENTION

1. Field of the Invention

The present invention relates to a toner for developing electrostatic images for use in electrophotographic apparatuses utilizing the electrophotographic process such as copying machines, printers and facsimiles, and an electrostatic image developer and an image-forming method using the same.

2. Description of the Related Art

Conventionally, various fixing methods for fixing toner for developing electrostatic images (hereinafter, referred to simply as "toner") are known, including a pressure fixing method using only a pressure roll at room temperature, a contact-heating fixing method using a heating roll or the like, an oven fixing method using oven heating, a flash fixing method using, for example, a xenon lamp, an electromagnetic wave fixing method using, for example, a microwave, and non-contact fixing methods such as a solvent fixing method using solvent vapor. Among them, the oven-heating and contact-heating fixing methods have been predominantly used due to their reliability and stability.

In particular, the contact-heating fixing methods using, for example, a heating roll and a belt, by which images are fixed in a fixing unit normally including a combination of a heating roll or belt provided with a heat source and a pressure roll or belt by bringing the toner image face of a recording medium into contact with, while conveying it past, the heating roll or belt surface under pressure, are higher in thermal efficiency and allow rapid fixing because the heating roll or belt surface and the toner image face of the recording material are brought into contact with each other directly, and thus are used widely.

In these thermal-fixing methods, fixing at a lower temperature is desirable for reducing energy consumption and shortening the so-called warm-up time, i.e., the period from the time of turning on the device to the time when the temperature of the fixing unit reaches operation temperature and the fixing unit becomes ready for operation. Recently, in particular, there has been demand for interrupting the power supply to the fixing unit when it is not in use for further energy conservation, which in turn requires that the fixing member in the fixing unit is heated to a desirable fixing temperature immediately after the start of power supply, and thus fixing at a yet further reduced temperature is desirable.

Reduction of the fixing temperature is also favorable from the viewpoint of cost, as it enables acceleration of printing speed even at the same power consumption level and extension of the lifetime of the heating roll and other parts in the contact-heating fixing method.

However, in conventional methods, a decrease in the fixing temperature of toner is accompanied by a decrease in the glass transition point of the toner particles, which makes it difficult to preserve the storability of the toner. Accordingly, for well-balanced low-temperature fixing and toner storability, it is necessary to provide the toner with a so-called sharp melting property, by which the toner retains a high glass transition point and exhibits a sharp decrease in viscosity in the high temperature range.

However, amorphous resins, which are the resins commonly used for toner, have, for example, glass transition points and molecular weights in relatively wide ranges, and thus, it is necessary to control the composition and molecular weight of a resin extremely precisely to give a resin having a sharp melting property. However, such strict control of a resin demands a special manufacturing process for production of the resin or a special treatment for control of the resin molecular weight (for example, purification of the resin by chromatography), thereby raising the cost for producing the resin and also providing an unnecessary resin, which is not preferable from the recent perspective of environmental protection.

Methods of using a crystalline resin as the binder resin in order to improve low-temperature fixing efficiency have been studied (e.g., Japanese Patent Application Publication (JP-B) Nos. 56-13943, 62-39428 and 63-25335, the disclosures of which are incorporated by reference herein). By using a crystalline resin, low-temperature fixing can be attained, since a toner retains its hardness up until the melting point of the crystal and exhibits a sharp decrease in viscosity at a temperature exceeding the melting point together with the melting of the crystal. However, the crystalline resins described in the literature above were problematic in that the fixing performance thereof on paper is insufficient.

Crystalline resins promising to have improved fixing efficiency on paper are crystalline polyester resins. A method of using a noncrystalline polyester resin having a glass transition temperature of higher than 40° C. and a crystalline polyester resin having a melting point of 130° C. to 200° C. in combination has been proposed as a toner using crystalline polyester resins (e.g., JP-B No. 62-39428, the disclosure of which is incorporated by reference herein). Although the toner prepared by the method is superior in pulverization efficiency and blocking resistance, it is not possible to fix the toner at a temperature lower than before because the melting point of the crystalline polyester resin is relatively high.

Alternatively, toners containing a resin having a melting point of 110° C. or less (as the crystalline resin) and an amorphous resin in combination have also been proposed (e.g., JP-B No. 4-30014, the disclosure of which is incorporated by reference herein). However, combined use of crystalline and amorphous resins leads to a drop in the melting point of the toner, causing problems such as toner blocking and deterioration in powder flowability.

Alternatively, a method of using a crystalline polyester resin and an amorphous resin in combination and fusing the crystalline component using the history of the temperature in the fixing step, and thus preventing blocking of paper during discharge from the fixing unit and also retaining transparency, has been proposed (e.g., Japanese Patent Application Laid-Open (JP-A) No. 2003-50478, the disclosure of which is incorporated by reference herein). However because the crystalline and amorphous resins are fused with each other in the fixed image and thus the melting point of the toner in the fixed image is brought down as described above, the method causes the problem that the toner images once formed on a paper are often transferred onto another paper facing the printed image, resulting in image defects, when the images are exposed to pressure and heat, for example, during conveyance, transportation, or storage in summer.

If the binder resin contains an amorphous resin component in a greater amount, the toner has properties more dependent on the amorphous resin component, and thus it is difficult to lower the fixing temperature beyond previous reductions.

Thus, for practical use, it is necessary to use a crystalline resin alone or in combination with an extremely small amount of an amorphous resin. As described above, it has been difficult with the conventional technology to simultaneously satisfy the requirements in low-temperature fixing efficiency, toner storage stability, and storage stability of a fixed image under heat and pressure.

SUMMARY OF THE INVENTION

The present invention was completed in view of the above circumstances. Thus, the invention provides a toner for developing electrostatic images containing a low-melting point crystalline polyester resin and an amorphous resin as the principal components for its binder resin and having the thermal properties of the toner derived from these resins controlled in a particular range that allows fixing at a temperature lower than previously, which enables drastic energy conservation in the fixing step and is superior in toner storage life and image storage stability, and an electrostatic image developer and an image-forming method using the same.

A first aspect of the invention provides a toner for developing electrostatic images, comprising a binder resin and a colorant, the binder resin comprising a crystalline polyester resin and an amorphous resin, wherein:

when, in differential scanning calorimetry of the toner according to ASTM D3418-8, the temperature of an endothermic peak derived from the crystalline polyester resin in a first heating process is defined as Tm1 (° C.), an endothermic quantity based on the endothermic peak in the first heating process is defined as ΔH1 (mW/g), and an endothermic quantity based on an endothermic peak in a second heating process is defined as ΔH2 (mW/g), Tm1 is 50 to 80° C., and ΔH1 and ΔH2 satisfy the relationship represented by the following Formula (1);

when the softening temperature of the toner is defined as $T_{f1/2}$ (0° C.), $T_{f1/2}$ is 85 to 135° C.; and Tm1 and $T_{f1/2}$ satisfy the relationship represented by the following Formula (2):

$$0.35 \leqq \Delta H2/\Delta H1 \leqq 0.95 \quad \text{Formula (1)}$$

$$T_{f1/2} \leqq 205-(1.4 \times Tm1) \quad \text{Formula (2)}$$

A second aspect of the invention provides an electrostatic image developer containing the toner for developing electrostatic images described in the first aspect.

A third aspect of the invention provides an image-forming method, comprising forming an electrostatic image on a latent image-holding member surface, developing the electrostatic image formed on the latent image-holding member surface with a developer containing a toner to form a toner image, transferring the toner image onto a transfer material surface, and heat-fixing the toner image transferred on the transfer material surface, wherein the toner used is the toner for developing electrostatic images described in the first aspect.

DETAILED DESCRIPTION OF THE INVENTION

Figure 1:
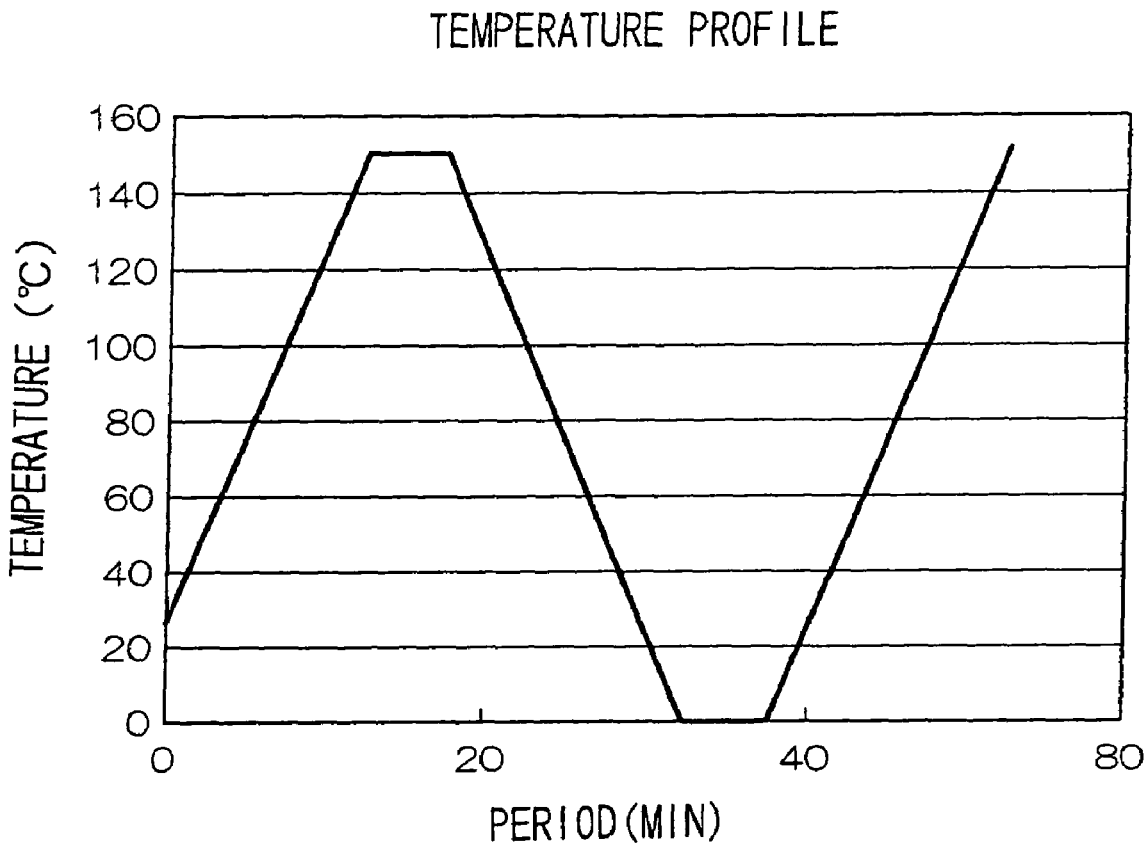
FIG. 1 is a chart showing the temperature profile of the differential scanning calorimetry used in the present invention.

Hereinafter, the present invention will be described in detail.

<Toner for Developing Electrostatic Images>

The toner for developing electrostatic images according to the invention is an electrostatic image-developing toner containing at least a binder resin and a colorant, wherein the binder resin contains a crystalline polyester resin and an amorphous resin. When, in the differential scanning calorimetry of the toner according to ASTM D3418-8, the disclosure of which is incorporated by reference herein, the temperature of the endothermic peak derived from the crystalline polyester resin in a first heating process is defined as Tm1 (° C.), the endothermic quantity based on the endothermic peak of the first heating process is defined as ΔH1 (mW/g) and the endothermic quantity based on the endothermic peak in the second heating process is defined as ΔH2 (mW/g), Tm1 is in the range of 50 to 80° C., and ΔH1 and ΔH2 satisfy the relationship represented by the following Formula (1). When the softening temperature of the toner is defined as $T_{f1/2}$ (° C.), $T_{f1/2}$ is in the range of 85 to 135° C. Furthermore, Tm1 and $T_{f1/2}$ satisfy the relationship represented by the following Formula (2).

$$0.35 \leqq \Delta H2/\Delta H1 \leqq 0.95 \quad \text{Formula (1)}$$

$$T_{f1/2} \leqq 205-1.4 \times Tm1 \quad \text{Formula (2)}$$

The toner according to the invention contains a crystalline polyester resin and an amorphous resin in the binder resin, and when the toner is analyzed by differential scanning calorimetry (DSC) according to ASTM D3418-8, the first heating process can be understood to correspond to the thermal fixing step in an actual machine, while the second heating process to the heat stability of an image after the fixing. Alternatively, the ratio ΔH2/ΔH1 of the endothermic quantities ΔH1 and ΔH2, which are respectively determined from the melting peak of the crystalline polyester resin in toner in the first and second heating processes, indicates a change in the crystallinity of the crystalline polyester resin before and after toner fixing, that is, a ratio of the crystalline resin that is once fused into a molten state by the heat energy in the fixing step and then recrystallized by cooling.

During toner fixing, the crystalline polyester resin begins to melt when the toner temperature reaches the melting point of the crystalline polyester resin. In the invention, the melting point of the crystalline polyester resin (endothermic peak temperature in the first heating process Tm1) should be in the range of 50 to 80° C., more preferably 55 to 75° C., and still more preferably 55 to 72° C. When Tm1 exceeds 80° C., low-temperature fixing becomes difficult because the amount of heat energy needed for fixing increases. When Tm1 is less than 50° C., part of the crystalline polyester resin in the toner begins to melt under normal storage conditions, resulting in impaired storage stability.

The crystalline polyester resin melted by the heat energy in the fixing step and the amorphous resin become fused with each other or separated in phases from each other, depending on the compatibility between them. An amorphous resin fused with the crystalline polyester resin melted during fixing is plasticized, and as a result, the toner can be fixed at a temperature significantly lower than that of the original amorphous resin only. On the other hand, if not completely fused with the amorphous resin structurally, the crystalline polyester resin fused with the amorphous resin at high temperature in the fixing step is separated into a different phase from the amorphous resin by the decrease in temperature thereafter, to return back to its original crystalline state.

The recrystallization ratio then is determined by the compatibility between the crystalline polyester resin and the amorphous resin. A higher compatibility leads to a lower recrystallization ratio, while a lower compatibility to a higher recrystallization ratio.

As described above, the recrystallization ratio is represented by ΔH2/ΔH1 ratio, which is determined by differential scanning calorimetry, and in the invention, the ratio ΔH2/ΔH1 should satisfy the relationship represented by the following Formula (1):

$$0.35 \leqq \Delta H2/\Delta H1 \leqq 0.95 \quad \text{Formula (1)}$$

When ΔH2/ΔH1 is less than 0.35, the crystalline polyester resin and the amorphous resin are too compatible with each other such that most of the crystalline polyester resin fused with the amorphous resin during fixing remains fused with the amorphous resin even after cooling and, as a whole, the amorphous resin remains plasticized. The plasticized amorphous resin has a significantly lower glass transition point, consequently causing the problem of impaired storage stability of the fixed image.

On the other hand, when the ΔH2/ΔH1 ratio is more than 0.95, the compatibility between the crystalline polyester resin and the amorphous resin is lower, and almost all crystalline polyester resin is recrystallized. In such a case, the compatibility between the crystalline polyester resin and the amorphous resin is very low, making low-temperature fixing insufficient because the resins are not fused with each other during fixing and thus the amorphous resin is not plasticized.

In the invention, the ΔH2/ΔH1 ratio satisfies $0.35 \leqq \Delta H2/\Delta H1 \leqq 0.95$, preferably $0.40 \leqq \Delta H2/\Delta H1 \leqq 0.85$, and more preferably $0.40 \leqq \Delta H2/\Delta H1 \leqq 0.75$.

The glass transition point derived from the amorphous resin is also determined by the differential scanning calorimetry according to ASTM D3418-8 described above. When the glass transition temperature in the first heating process is defined as Tg1 (° C.) and the glass transition temperature in the second heating process is defined as Tg2 (° C.), the difference between them (Tg1−Tg2) is preferably in the range of 5 to 15° C., and more preferably 5 to 10° C., in the invention.

In particular, the glass transition point of the toner is a factor governing the storability of toner (blocking resistance) and, for example, a binder resin for toner having a lower glass transition point results in blocking and decrease in storability, even when the toner is coated with various particles on the surface. On the other hand, the glass transition point also has a close relationship with fixing efficiency, and a higher glass transition point generally leads to a higher fixing temperature.

Accordingly, for assuring favorable storability and low-temperature fixing efficiency, a toner having a high glass transition temperature Tg1 in the first heating process which corresponds to a glass transition point before fixing, and showing a low-temperature fixing efficiency similar to that of a toner containing a binder resin having a low glass transition temperature, due to the drop of Tg1 by the heat during fixing, is preferable. The glass transition temperature lowered during the fixing corresponds to the glass transition temperature Tg2 in the second heating process, and thus the difference Tg1−Tg2 is preferably a particular value or more as described above.

A difference Tg1−Tg2 of less than 5° C. may hinder the balance between favorable toner storability and low-temperature fixing efficiency. A difference Tg1−Tg2 of over 15° C. may result in insufficient image storability after fixation.

The glass transition temperature in the first heating process Tg1 is preferably in the range of 45 to 70° C. and more preferably 50 to 60° C. Tg1 of lower than 45° C. may result in insufficient toner storability, while a Tg1 of higher than 70° C. may demand excessively high heat energy and a longer period for heat fusion of the toner when the toner is produced by the wet production process described below, in particular in an emulsion polymerization aggregation process.

The differential thermal analysis in the invention, including the measurement of endothermic quantity described above, is conducted in accordance with that specified by ASTM D3418-8, and the measurement is performed specifically according to the temperature profile as shown in FIG. 1.

That is, a toner to be analyzed is placed in a differential scanning calorimeter equipped with an automatic tangent-line-processing system manufactured by Shimadzu Corporation (DSC-50); heated from room temperature to 150° C. at a rate of 10° C./min (first heating process), giving a relationship between the temperature (° C.) and the quantity of heat (mW); cooled to 0° C. at a rate of 10° C./min; and then reheated up to 150° C. at a rate of 10° C./min (second heating process), giving other data. The toner is held at 0° C. and 150° C. respectively for 5 minutes.

Figure 2:
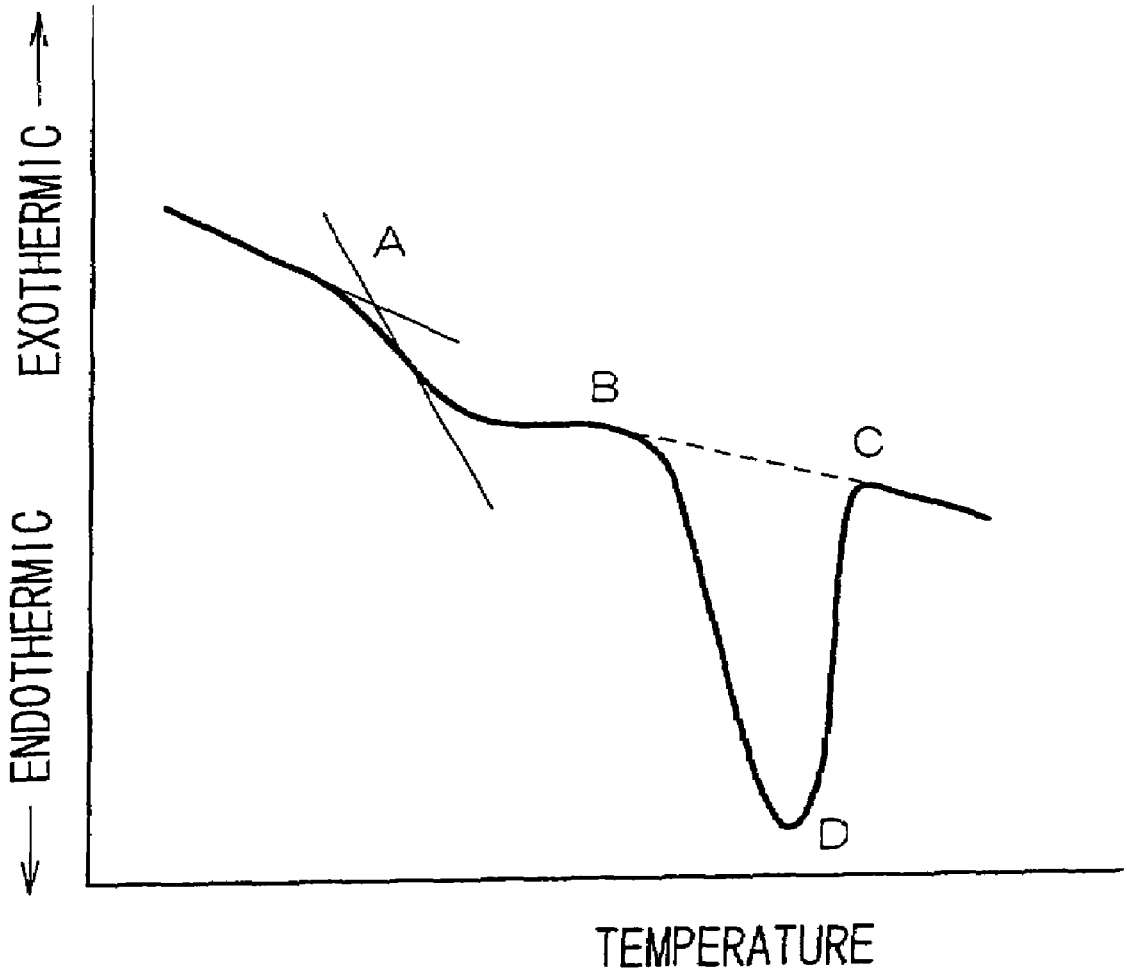
FIG. 2 is a chart showing an example of the endothermic/exothermic curve obtained by the differential scanning calorimetry in the invention.

An example of the DSC curve (endothermic/exothermic curve) obtained is shown as a schematic diagram in FIG. 2. Curves similar to that shown in FIG. 2 are obtained both in the first and second heating processes, and Tm1 is determined from the endothermic peak top D which is due to the fusion of the crystalline polyester resin, and endothermic quantity ΔH from the area of the endothermic peak (area enclosed by the curve and the dotted line between B and C) in the curve. Separately, Tg1 and Tg2 are determined from the intersection A between the base line and the downward slope in the stepwise endothermic peak that is observed independent of the endothermic peak.

As described above, in the toner according to the invention, the amorphous resin in the binder resin can be fused with the crystalline polyester resin which is melted during fixing, and plasticized, whereby the toner can be fixed at low temperature. For enabling fixing at such low temperature and improving the toner storage stability and image stability after fixation due to fusion of the amorphous resin with the crystalline polyester resin and plasticization of the amorphous resin, the softening temperature $T_{f1/2}$ of the toner should be in the range of 85 to 135° C.

When the toner softening temperature $T_{f1/2}$ is lower than 85° C., the resin plasticized during fixing exhibits a sharp decrease in viscosity and is thus advantageous for low-temperature fixation, but is also accompanied with more frequent offsetting at higher temperature and consequently restricts the range of desirable fixing temperature. Alternatively, when it is higher than 135° C., even if the amorphous resin is fused with the crystalline resin and plasticized, the toner still has a high viscosity, resulting in an insufficient fixing efficiency at low temperature. In the invention, the softening temperature $T_{f1/2}$ is preferably in the range of 85 to 125° C. and more preferably 85 to 115° C.

The softening temperature $T_{f1/2}$ in the invention is determined as a temperature corresponding to the center value between the temperatures of initiation and termination of flow when a 1 $cm^3$ sample is melted and allowed to flow in a flow tester CFT-500 (manufactured by Shimadzu Co.), under the conditions of a dice micropore diameter of 0.5 mm, an applied pressure of 0.98 MPa (10 $kg/cm^2$), and a heating rate of 1° C./min.

In addition, in the invention, the melting point Tm1 of the crystalline resin and the softening temperature $T_{f1/2}$ of the amorphous resin should satisfy the relationship represented by the following Formula (2):

$$T_{f1/2} \leqq 205-(1.4 \times Tm1) \quad \text{Formula (2)}$$

Although Formula (2) is an experimental equation, if the melting point of the crystalline polyester resin Tm1 and the softening temperature of the toner $T_{f1/2}$ do not satisfy the experimental equation, the fused and plasticized amorphous resin does not exhibit a decrease in viscosity to a level for sufficient fixing, consequently leading to insufficient fixing.

Hereinafter, the components and the production method of the toner for developing electrostatic images according to the invention will be described.

The toner for developing electrostatic images according to the invention contains at least a binder resin and a colorant, and as needed other components. First, the components for the toner according to the invention will be described respectively.

(Binder Resin)

—Crystalline Polyester Resin—

In the invention, the "crystalline polyester resin" is a polyester resin having a distinct endothermic peak, which is not a stepwise change in endothermic quantity, when determined by differential scanning calorimetry (DSC). In addition, among copolymers containing main chains of the crystalline polyester above and other components, copolymers containing the other components in an amount of 50 wt % or less are also called crystalline polyester resins.

The crystalline polyester resin for use in the invention preferably has an ester concentration M represented by the following Formula (3) of 0.01 to 0.12:

$$M=K/A \quad \text{Formula (3)}$$

In Formula (3) above, M represents an ester concentration; K represents the number of ester groups in the polymer; and A represents the number of atoms constituting the polymer chain of the polymer.

The "ester concentration M" is an indicator of the content of ester groups in the crystalline polyester resin polymer. In other words, the "number of ester groups in the polymer" represented by K in Formula (1) above is the number of ester bonds contained in the entire polymer.

The "number of atoms constituting the polymer chain of the polymer" represented by A in Formula (3) above is the total number of atoms constituting the polymer chain of the polymer, including the number of all atoms involved in the ester bond but excluding that of atoms in the branched regions on the polymer chain. Namely, carbon and oxygen atoms derived from the carboxyl and alcohol groups involved in ester bonding (two oxygen atoms per ester bond) and carbon atoms constituting the polymer chain, for example six carbon atoms in the case of an aromatic ring, are included in calculation of the atom number, but the hydrogen atoms and the substituent atoms or atom groups, for example, on the aromatic ring or the alkyl group constituting the polymer chain are not included in the calculation of the atom number.

More specifically, among ten atoms, six carbon and four hydrogen atoms, of an arylene group constituting the polymer chain, only six carbon atoms are included in the "number of atoms A constituting the polymer chain of the polymer", and if the hydrogen is substituted with any substituent group, the atoms constituting the substituent group are not included in "number of atoms A constituting the polymer chain of the polymer".

If a crystalline polyester resin is a homopolymer having only one recurring unit (for example, when the polymer is represented by $H—[OCOR^1COOR^2O—]_n—H$, one recurring unit is the unit represented in [ ]); and because two ester bonds are present in one recurring unit (i.e., number of ester groups K' is 2 in the recurring unit), the ester concentration M is calculated according to the following Formula (3-1):

$$M=2/A' \quad \text{Formula (3-1)}$$

In the Formula above, M represents the ester concentration, and A' represents the number of atoms constituting the polymer chain in one recurring unit.

Alternatively, if the crystalline polyester resin is a copolymer containing multiple copolymerization units, the ester concentration M can be calculated by determining the number of ester groups $K^x$ and the number of atoms constituting the polymer chain $A^x$ in each copolymerization unit, multiplying them by each copolymerization ratio, summarizing them, and substituting them into Formula (3) above. For example, the ester concentration M of a compound $[(Xa)_a(Xb)_b(Xc)_c]$ having copolymerization units of Xa, Xb and Xc and copolymerization ratios of a:b:c (wherein, a+b+c=1) is determined by the following Formula (3-2):

$$M=(K^{Xa}xa+K^{Xb}xb+K^{Xc}xc)/(A^{Xa}xa+A^{Xb}xb+A^{Xc}xc) \quad \text{Formula (3-2)}$$

In Formula (3-2) above, M represents the ester concentration; $K^{Xa}$, $K^{Xb}$, and $K^{Xc}$ represent the numbers of ester groups respectively in the copolymerization units Xa, Xb, and Xc; and $A^{Xa}$, $A^{Xb}$, and $A^{Xc}$ represent the numbers of the atoms constituting the polymer chain respectively in the copolymerization units Xa, Xb, and Xc.

Crystalline polyester resins having an ester concentration M of less than 0.01 are superior in electrostatic properties, but may lead to deterioration in resin low-temperature fixing efficiency due to drastic heightening of the melting point. The lower limit of the ester concentration M is more preferably 0.04 or more.

Alternatively, crystalline polyester resins having an ester concentration M of more than 0.12 may have inferior electrostatic properties, leading to decrease in the stability of fixed images and the powder-blocking resistance due to drastic drop in the resin melting point. The upper limit of the ester concentration M is preferably 0.10 or less.

The crystalline polyester resins are prepared from acid (dicarboxylic acid) components and alcohol (diol) components, and in the invention, the "acid-derived constituent component" indicates the region in the polyester resins which are acid components before preparation of the polyester resins, and the "alcohol-derived constituent component" the regions which are alcohol components before preparation of the polyester resins.

—Acid Derived Constituent Component—

Acid which is to be the above acid-derived constituent component includes various dicarboxylic acids. The acid-derived constituent component of the crystalline polyester resin in the invention is preferably an aromatic dicarboxylic acid or an aliphatic dicarboxylic acid. Among these, the aliphatic dicarboxylic acid is desirable and, in particular, a straight chain-type carboxylic acid is desirable.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,11-undecanedicarboxylic acid, 1,12-dodecanedicarboxylic acid, 1,13-tridecanedicarboxylic acid, 1,14-tetradecanedicarboxylic acid, 1, 16-hexadecanedicarboxylic acid, 1,18-octadecanedicarboxylic acid, and the like, and lower alkyl esters and acid anhydrides thereof. However, the aliphatic dicarboxylic acid is not limited to these. Of these, if availability is taken into account, sebacic acid, 1, 10-decanedicarboxylic acid, lower alkyl esters thereof and acid anhydride thereof are preferable.

Examples of the aromatic dicarboxylic acid include terephthalic acid, isophthalic acid, 2,6-naphthalenedicarboxylic acid, 4,4'-biphenyldicarboxylic acid, and the like. Of these, terephthalic acid is preferable from the point of availability, the point of it being is easy to form a low melting point polymer, and the like.

As the above acid-derived constituent component, in addition to the aforementioned aliphatic dicarboxylic acid-derived constituent component or aromatic dicarboxylic acid-derived constituent component, it is also preferable that the resin includes a constituent component such as a dicarboxylic acid-derived constituent component having a double bond, a dicarboxylic acid-derived constituent component having a sulfonic acid group, or the like.

It should be noted that, in addition to the constituent component which is derived from the dicarboxylic acid having a double bond, the above dicarboxylic acid-derived constituent component having a double bond includes a constituent component derived from a lower alkyl ester, acid anhydride or the like of a dicarboxylic acid having a double bond. Moreover, in addition to the constituent component which is derived from a dicarboxylic acid having a sulfonic acid group, the above dicarboxylic acid-derived constituent component having a sulfonic acid group includes a constituent component derived from a lower alkyl ester, acid anhydride or the like of a dicarboxylic acid having a sulfonic acid group.

Because the entire resin can be crosslinked using the double bond, the above dicarboxylic acid having a double bond can be used preferably in order to prevent hot offset at a time of fixing. Examples of the dicarboxylic acid includes fumaric acid, maleic acid, 3-hexenedioic acid, 3-octenedioic acid, and the like. However, the dicarboxylic acid is not limited to these. Further, lower alkyl esters, acid anhydrides, and the like thereof are also included. Of these, fumaric acid, maleic acid, and the like are preferable from the point of cost.

The above dicarboxylic acid having a sulfonic acid group is effective from the point that a coloring material such as a pigment or the like can be well dispersed. Further, when the entire resin is emulsified or suspended in water and a particulates is thereby prepared, if there is a sulfonic acid group, emulsification or suspension can be carried out without using a surfactant. Examples of the dicarboxylic acid having a sulfonic acid group includes 2-sulfoterephthalic acid sodium salt, 5-sulfoisophthalic acid sodium salt, sulfosuccinic acid sodium salt, and the like. However, the dicarboxylic acid having a sulfonic acid group is not limited to these. Moreover, the lower alkyl esters, acid anhydrides, and the like thereof are also included. Of these, 5-sulfoisophthalic acid sodium salt is preferable from the point of cost.

The amount of content of among all acid-derived constituent components of acid-derived constituent components other than the aliphatic dicarboxylic acid-derived constituent component and the aromatic dicarboxylic acid-derived constituent component (i.e., the dicarboxylic acid-derived constituent component having a double bond and/or the dicarboxylic acid-derived constituent component having a sulfonic acid group) is preferably from 1 to 20 mole % by constitution and is more preferably from 2 to 10 mole % by constitution.

If the above amount of content is less than 1 mole % by constitution, pigment dispersion is not good or emulsified particle size is large. Consequently, it may be difficult to adjust toner size due to flocculation. On the other hand, if the amount of content exceeds 20 mole % by constitution, the crystallinity of the polyester resin is reduced and the melting point drops, such that the storability of an image may be deteriorated. Alternatively, a part of the emulsified resin may be dissolved in water, such that a latex may become unstable.

In the present specification, "mole % by constitution" indicates a percentage of an acid derived constituent component based on one unit (mol) of the total acid derived constituent components in the polyester resin or an alcohol derived constituent component based on one unit (mol) of the total alcohol derived constituent components in the polyester resin.

—Alcohol-Derived Constituent Component—

The alcohol which is to become an alcohol-derived constituent component is preferably an aliphatic diol and is more preferably a straight chain-type aliphatic diol having 7 to 20 carbon atoms. If the above aliphatic diol is a branched type, the crystallinity of the polyester resin lowers and the melting point drops. Accordingly, the toner blocking resistance, the image storability, and the low temperature fixing efficiency may be deteriorated. Further, if the number of the carbon atoms is less than 7, when the aliphatic diol is subjected to condensation polymerization with an aromatic dicarboxylic acid, the melting point becomes high and low temperature fixing may be difficult. On the other hand, if the number of the chain carbon atoms exceeds 20, it tends to be difficult to obtain practical materials. The number of chain carbon atoms is more preferably 14 or less.

Further, when the aliphatic diol is subjected to condensation polymerization with an aromatic dicarboxylic acid and thereby polyester is obtained, the above number of chain carbon atoms is preferably an odd number. In the case in which the above number of chain carbon atoms is an odd number, the melting point of the polyester resin is lower as compared to a case in which the number of chain carbon atoms is an even number. Consequently, it is easier to have the melting point be a value which falls within a preferable range of numerical values, which will be described later.

More specifically, examples of the aliphatic diol includes ethylene glycol, 1, 3-propanediol, 1,4-butanediol, 1,5-pentanediol, 1,6-hexanediol, 1,7-heptanediol, 1, 8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and the like. However, the aliphatic diol is not limited to these. Of these, when availability is taken into consideration, 1,8-octanediol, 1,9-nonanediol, 1,10-decanediol are preferable. Moreover, 1,9-nonanediaol is preferable from the point of low melting point.

In the above alcohol-derived constituent component, the amount of content of the aliphatic diol-derived constituent component is 80 mole % by constitution or more. The alcohol-derived constituent component includes other components as necessary. In the above alcohol-derived constituent component, the amount of content of the above aliphatic diol-derived constituent component is preferably 90 mole % by constitution or more.

If the amount of content of the above aliphatic diol-derived constituent component is less than 80 mole % by constitution, the crystallinity of the polyester resin lowers, and thus the melting point drops. As a result, the toner blocking resistance, the image storability, and the low temperature fixing efficiency may be deteriorated.

The other components which are included as necessary are constituent components such as a diol-derived constituent component having a double bond(s), a diol-derived constituent component having a sulfonic acid group(s), and the like.

Examples of the above diol-derived constituent component having a double bond includes 2-butene-1,4-diol, 3-butene-1,6-diol, 4-butene-1,8-diol, and the like.

Examples of the above diol having a sulfonic acid group include 1,4-dihydroxy-2-sulfonic acid benzene sodium salt, 1,3-dihydroxymethyl-5-sulfonic acid benzene sodium salt, 2-sulfo-1,4-butanediol sodium salt, and the like.

If alcohol-derived constituent components (i.e., the diol-derived constituent component having a double bond and/or the diol-derived constituent component having a sulfonic acid group) other than the aliphatic diol-derived constituent component are added, the amount of content of the other alcohol-derived constituent components is preferably from 1 to 20 mole % by constitution and is more preferably from 2 to 10 mole % by constitution.

If the amount of content of the alcohol-derived constituent components other than the above aliphatic diol-derived constituent component is less than 1 mole % by constitution, the pigment dispersion is not good or the emulsified particle size is large. Thus, it may be difficult to adjust the toner size by flocculation. On the other hand, if the amount of content exceeds 20 mole % by constitution, the crystallinity of the polyester resin lowers or the melting point drops, such that the storability of an image may be deteriorated. Alternatively, a part of the emulsified particles are dissolved in water, such that a latex may become unstable.

A method of manufacturing the above crystalline polyester resin is not limited in particular. The crystalline polyester resin can be manufactured in accordance with a general polyester polymerization method which causes an acid component and an alcohol component to react. For example, the crystalline polyester resin is manufactured using direct polycondensation, a transesterification method, or the like in accordance with the type of a monomer. When the above acid component and the above alcohol component are caused to react, since a mole ratio (acid component/alcohol component) varies due to reaction conditions or the like, the mole ratio cannot be generalized. Usually, the mole ratio is approximately 1/1.

The above polyester resin can be manufactured at a polymerization temperature of between 180 and 230° C. Pressure within a reaction system is reduced as necessary, and the reaction is carried out while removing water or alcohol which is generated at the time of condensation. If the monomer does not dissolve or is not compatible at the reaction temperature, a high boiling point solvent is added thereto as a solubilizing agent and thus the monomer is dissolved. The polycondensation reaction is effected while removing the solubilizing agent by distillation. If there is a poorly compatible monomer in the copolymerization reaction, the poorly compatible monomer is subjected to condensation beforehand with the acid or alcohol which is scheduled for polycondensation, and then the condensed product is subjected to polycondensation with the main component.

Examples of a catalyst which can be used when the above polyester resin is manufactured include: compounds of alkaline metals such as sodium, lithium, and the like; compounds of alkaline earth metals such as magnesium, calcium, or the like; a metal compound such as zinc, manganese, antimony, titanium, tin, zirconium, germanium, and the like; a phosphorous acid compounds; phosphoric acid compounds; amine compounds; and the like. More specifically, the following compounds are included.

For example, there are compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenylphosphite, tris (2,4-di-t-butylphenyl) phosphite, ethyltriphenylphosphoniumbromide, triethylamine, triphenylamine, and the like.

The melting point of the crystalline polyester resin above is preferably in the range of 60 to 120° C. and more preferably 60 to 100° C. If the melting point is lower than 60° C., it may be difficult to secure a toner melting point of 50° C. or higher since the melting point may drop during toner production, which may also cause more frequent generation of powder aggregation and deterioration of the storability of fixed images. Alternatively, if the melting point is higher than 120° C., it may be difficult to secure a toner melting point of 80° C. or less, although the melting point may drop during toner production, which may prohibit low-temperature fixation.

The melting point of the crystalline polyester resin in the toner, which is 50 to 80° C. in the invention, is the melting point of the toner which has been prepared. The melting point of a crystalline polyester resin as a material has a close relationship with that of the toner using the same, but the relationship varies according to the structure and the blending ratio of the amorphous resin, one of the other components of the toner in the invention, and thus, the melting point of the crystalline polyester resin per se is not limited here in the invention.

In the invention, the melting point of the crystalline polyester resin can be determined as the peak melting temperature, by heating the resin from room temperature to 150° C. at a rate of 10° C. per minute by differential thermal analysis according to ASTM D3418-8 in the differential scanning calorimeter (DSC) described above. If the resin has multiple melting peaks in the measurement above, the maximum peak temperature is regarded as the melting point in the invention.

—Amorphous Resin—

Examples of the amorphous resins for use as the toner according to the invention include known thermoplastic binder resins, and specific examples thereof include homopolymers or copolymers of styrenes (styrene resins) such as styrene, p-chlorostyrene, and α-methylstyrene; homopolymers or copolymers of vinyl group-containing esters (vinyl resins) such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; homopolymers or copolymers of vinyl nitriles (vinyl resins) such as acrylonitrile and methacrylonitrile; homopolymers or copolymers of vinylethers (vinyl resins) such as vinylmethylether and vinylisobutylether; homopolymer or copolymer of vinylketones (vinyl resins) such as vinylmethylketone, vinylethylketone, and vinylisopropenylketone; homopolymers or copolymers of olefins (olefin resins) such as ethylene, propylene, butadiene, and isoprene; non-vinyl condensation resins such as epoxy resins, polyester resins, polyurethane resins, polyamide resins, cellulosic resins, and polyether resins; graft polymers between a non-vinyl resin and a vinyl monomer; and the like.

These resins may be used alone or in combination of two or more. Among these resins, vinyl and polyester resins are particularly preferable.

The vinyl resins above are advantageous in that it is possible to produce a resin particle dispersion containing particles having an average particle size of 1 μm or less easily, for example, by using an ionic surfactant in emulsion or seeding polymerization. Favorable examples of the vinyl monomers include monomers for vinyl polymer acids or bases such as acrylic acid, methacrylic acid, maleic acid, cinnamic acid, fumaric acid, vinylsulfonic acid, ethyleneimine, vinylpyridine, and vinylamine.

In the invention, the resin particles described above preferably contain one of the vinyl monomers above as a monomer component. In the invention, vinyl polymer acids are more preferable among these vinyl monomers, from the point of the easiness of the vinyl resin-forming reaction; and specifically, dissociative vinyl monomers having a carboxyl group as the dissociative group, such as acrylic acid, methacrylic acid, maleic acid, cinnamic acid, and fumaric acid, are particularly preferable for control of the polymerization degree and the glass transition point of resin.

The concentration of the dissociation group in the dissociative vinyl monomer can be determined, for example, by the quantitative determination method of dissolving particles such as toner particles from the surface that is described in "Chemistry of Polymer Latex" (Kobunshi Kankokai). The molecular weight and the glass transition point of resin in the regions of the particle from surface to inside can also be determined by the method above and others.

On the other hand, use of a polyester resin as the amorphous resin in the toner according to the invention is advantageous in that it is possible to produce a resin particle dispersion easily by adjusting the acid value of the resin and performing emulsification and dispersion by using an ionic surfactant and the like. The amorphous polyester resins for use in the emulsification and dispersion are prepared by dehydration condensation of a polyvalent carboxylic acid and a polyvalent alcohol.

Examples of the polyvalent carboxylic acids include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenylsuccinic anhydride, and adipic acid; and alicyclic carboxylic acids such as cyclohexanedicarboxylic acid. These polyvalent carboxylic acids may be used alone or in combination of two or more. Among the polyvalent carboxylic acids above, use of an aromatic carboxylic acid is preferable; combined use of a dicarboxylic acid and a trivalent or higher carboxylic acid (trimellitic acid, the acid anhydride thereof, or the like) is preferable to provide the amorphous polyester resin with a favorable fixing efficiency and a crosslinked or branched structure.

Examples of the polyvalent alcohols include aliphatic diols such as ethylene glycol, diethylene glycol, triethylene glycol, propylene glycol, butenediol, hexanediol, neopentylglycol, and glycerol; alicyclic diols such as cyclohexanediol, cyclohexanedimethanol, and hydrogenated bisphenol A; and aromatic diols such as ethylene oxide and propylene oxide adducts of bisphenol A. These polyvalent alcohols may be used alone or in combination of two or more. Among the polyvalent alcohols, aromatic and alicyclic diols are preferable, and aromatic diols are more preferable. A trivalent or higher polyvalent alcohol (glycerol, trimethylol propane, pentaerythritol) may be used together with a diol to provide the amorphous polyester resin with a favorable fixing efficiency and a crosslinked or branched structure.

The acid value of the polyester resin may be adjusted by adding a monocarboxylic acid and/or a monoalcohol to a polyester resin obtained by polycondensation of a polyvalent carboxylic acid and a polyvalent alcohol and thus esterifying the hydroxyl group and/or the carboxyl group at the polymerization terminals. Examples of the monocarboxylic acids include acetic acid, acetic anhydride, benzoic acid, trichloroacetic acid, trifluoroacetic acid, propionic anhydride, and the like; and examples of the monoalcohols include methanol, ethanol, propanol, octanol, 2-ethylhexanol, trifluoroethanol, trichloroethanol, hexafluoroisopropanol, phenol, and the like.

The method of producing the polyester resin above is not particularly limited, and the methods similar to those described for the crystalline polyester resins may be used.

In the invention, the weight-average molecular weight of the amorphous resin is preferably in the range of 7,000 to 100,000. Alternatively, the number-average molecular weight thereof is preferably in the range of 2,500 to 20,000. These molecular weights can be determined in the molecular weight measurement by gel-permeation chromatography (as polystyrene).

The glass transition temperature of the amorphous resin according to the invention is preferably in the range of 45 to 65° C. and more preferably, 50 to 65° C. If the amorphous resins has a glass transition temperature of lower than 45° C., blocking (a phenomenon whereby aggregates of toner particles are formed) during storage of, or development of, toner may be facilitated. Alternatively, if the amorphous resin has a glass transition temperature of higher than 65° C., it may raise the fixing temperature of the resulting toner.

The ratio $\Delta H2/\Delta H1$ in Formula (1) above can be controlled, for example, by modifying the structures of the crystalline polyester resin and the amorphous resin, adjusting the ratio of these resins, or controlling the dispersion structure during production.

The structural modification may be performed, for example, by altering the monomer units constituting the resins. In such a case, it is possible to increase the compatibility between the resins and decrease the ratio $\Delta H2/\Delta H1$ by narrowing the difference in the solubility parameters (SP values) of the resins, which are calculated according to the Fedors method (Polym. Eng. Sci., 14, 147 (1974)).

For example, it is possible to reduce the SP value of the polyester resin obtained, by changing the alcohol component of polyester from an ethylene oxide adduct of bisphenol A to an propylene oxide adduct. Alternatively, it is possible to raise the SP value by changing the dicarboxylic acid component from a fatty dicarboxylic acid such as sebacic acid to an aromatic dicarboxylic acid such as terephthalic acid.

The SP value of resin can also be actually determined by measuring the solubility thereof in a solvent having whose SP value is known. However, the actual fusion phenomenon between two resins is not governed only by the SP values, because the interaction between the resins is also involved.

In the invention, difference between the SP values of the crystalline polyester resin and the amorphous resin ($\Delta$SP value) as calculated according to the method described above is preferably in the range of 0.2 to 1.3 and more preferably 0.5 to 1.1.

In addition, a method of changing the blending ratio of resins is easier to practice and thus more convenient as the method of controlling the ratio $\Delta H2/\Delta H1$. However, the $\Delta H2/\Delta H1$ value fluctuates even at the same blending rate, depending on the combination of resins, and thus it is normally preferable to adjust both the resin structure and the blending rate.

In the invention, the mass ratio (A/B) of the crystalline polyester resin amount (A) to the amorphous resin amount (B) in the binder resin is preferably in the range of 2/98 to 50/50 and more preferably, 5/95 to 30/70.

Content of the crystalline polyester resin in an amount higher than A/B: 50/50 may result in a ΔH2/ΔH1 value of more than 0.95. Alternatively, content in an amount of less than 2/98 may result in a ΔH2/ΔH1 value of smaller than 0.35.

(Colorant)

The colorant in the toner of the present invention is not limited in particular. Known colorants can be applied and selected appropriately in response to purpose. A pigment may be used alone or two or more of a similar type of pigments may be mixed and used. Further, two or more different types of pigments may be mixed and used.

More specifically, examples of the above-described colorant include carbon black (furnace black, channel black, acetylene black, thermal black, and the like), inorganic pigments such as red iron oxide, aniline black, iron blue, titanium oxide, magnetic powder, and the like; azo pigments such as Fast Yellow, Monoazo Yellow, Disazo Yellow, pyrazolone red, chelate red, Brilliant Carmine (3B, 6B, and the like), Para Brown, and the like; phthalocyanine pigments such as copper phthalocyanine, nonmetal phthalocyanine, and the like; condensation polycyclic pigments such as flavanthrone yellow, dibromoanthrone orange, perylene red, Quinacridone Red, Dioxazine Violet, and the like; and the like.

Further, examples of the colorant include various pigments such as chrome yellow, Hansa Yellow, benzidine yellow, thren yellow, quinoline yellow, Permanent orange GTR, pyrazolone orange, vulcanized orange, watch young red, permanent red, Dupont oil red, lithol red, Rhodamine B Lake, Lake Red C, Rose bengal, aniline blue, ultramarine blue, Carcoyl blue, methylene blue chloride, Phthalocyanine blue, Phthalocyanine green, Marakite green oxalate, Para Brown, and the like; various dyes such as acridines, xanthenes, azos, benzoquinones, azines, anthraquinones, dioxazines, thiazines, azomethines, indigos, thioindigos, phthalocyanines, aniline blacks, polymethines, triphenylmethanes, diphenylmethanes, thiazoles, xanthenes, and the like; and the like. A black pigment such as carbon black or a dye may be mixed with these colorants to a degree such that transparency is not reduced. Moreover, disperse dyes, oil-soluble dyes, and the like are also included.

The content amount of the above colorant in the toner for developing electrostatic images of the present invention is preferably from 1 to 30 parts by mass based on 100 parts by mass of the above binder resin. It is preferable that the content amount of the colorant is as great as possible within this range of numerical values but in a range in which smoothness of the image surface after the fixing is not damaged. When the content amount of the colorant is increased, even if an image having the same density is obtained, the thickness of the image can be decreased. Thus, it is advantageous from the point of effectively preventing offset.

By selecting the type of the above colorant appropriately, respective color toners such as yellow toner, magenta toner, cyan toner, black toner, and the like can be obtained.

—Other Components—

The toner according to the invention is not particularly limited if it contains at least a crystalline polyester resin and an amorphous resin as the binder resin as described above, and may contain as needed other components, for example, a releasing agent. The method of producing toners according to the invention is not particularly limited, but is preferably a wet granulating method.

The releasing agent is used in general for the purpose of enhancing a releasing property.

Specific examples of the releasing agent include low molecular weight polyolefins such as polyethylene, polypropylene, polybutene, and the like; silicones having a softening point upon heating; fatty acid amides such as oleic amide, erucic amide, ricinoleic amide, stearic amide, and the like; vegetable waxes such as carnauba wax, rice wax, candelilla wax, haze wax, jojoba oil, and the like; animal waxes such as beeswax and the like; mineral/petroleum waxes such as montan wax, ozokerite, ceresin, paraffin wax, microcrystalline wax, Fischer-Tropsch wax, and the like; ester waxes such as fatty acid ester, montan acid ester, carboxylate, and the like; and the like.

In the invention, these releasing agents may be used alone or in combination of two or more; and combined use of two or more mold releasing agents is preferable.

In particular in the invention, preferable is use of at least two releasing agents having melting points respectively at the lower and higher sides of the endothermic peak temperature Tm1 derived from the crystalline polyester resin in toner. In addition, the melting point of the releasing agent in the lower-temperature side is preferably in the range of 30 to 55° C., and that of the releasing agent in the higher-temperature side is preferably in the range of 80 to 105° C.

As described above, combined used of two releasing agents can facilitate fixing at lower temperature because of sharp melting of the crystalline polyester resin and improve releasing property at lower and higher temperatures and offset resistance. The amount of these releasing agents added is preferably in the range of 0.5 to 50 mass % and more preferably 1 to 30 mass % with respect to the total amount of toner.

The above-described other components which can be used for the toner of the present invention are not limited in particular and can be selected appropriately in response to purpose. For example, the other components include various known additives such as inorganic particles, organic particles, a charge controlling agent, or the like.

The inorganic particles are used in general for the purpose of improving fluidity of the toner. Examples of the above inorganic particles include particles of silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, silicon nitride, and the like. Among these, silica particles are preferable, and silica particles which have been hydrophobized are particularly preferable.

The average primary particle size (number average particle size) of the inorganic particles is preferably from 1 to 1000 nm, and the amount added (from outside) thereof is preferably from 0.01 to 20 parts by mass based on 100 parts by mass of the toner.

The organic particles are used in general for the purpose of improving cleanability and transferability and sometimes for the purpose of improving chargeability. Examples of the organic particles include particles of polystyrene, polymethyl methacrylate, polyvinylidene fluoride, and the like.

The charge controlling agent is used in general for the purpose of improving chargeability. Examples of the charge controlling agent include metal salts of salicylic acid, metal-containing azo compounds, nigrosine, quaternary ammonium salts, and the like.

The toner for developing electrostatic images according to the invention has a structure in which the core particles containing the binder resin are covered with a surface layer. It is preferable that the surface layer does not have a significant influence on either the mechanical or melt viscoelastic properties of the entire toner. For example, a toner covered with a non-melting or high-melting point surface layer will not exhibit sufficient high low-temperature fixing efficiency due to use of a crystalline polyester resin.

Accordingly, the thickness of the surface layer is preferably as thin as possible, and specifically in the range of 0.001 to 1 μm. For forming a surface layer having a thickness in the range above, it is preferable to use a method of chemically treating the surface of the particles that contain a binder resin, the particles thereof, and a colorant as well as the inorganic particles and others added as needed.

Examples of the components for the surface layer include silane-coupling agents, isocyanates, vinyl monomers, resins, the particles thereof, and the like. Each of the components preferably has a polar group introduced, which increases the adhesive strength between the toner and recording material such as paper and the like by binding via chemical bonds.

The polar group is not particularly limited and any polarizable functional group may be used, and examples thereof include carboxyl, carbonyl, epoxy, ether, hydroxyl, amino, imino, cyano, amide, imide, ester and sulfone groups, and the like.

In the invention, the core particle surface is preferably coated with a coating resin, for prevention of the deterioration in powder flowability due to the exposure of a releasing agent on the toner surface and the blocking during storage.

The methods of the chemical treatment include, for example, oxidative methods such as oxidation with a strong oxidizing substance such as peroxide, ozone oxidation, and plasma oxidation, graft or seeding polymerization with a polymerizable monomer containing a polar group, and the like.

Alternatively the substance described above may be bound chemically or physically to the toner particle surface, forming a surface layer. For example, toner mother particles may be coated with resin particles under mechanical force, and such a method is desirable for adjusting the electrostatic properties of toner mother particles. Examples of such resin particles include particles of styrene resins, styrene-acrylic copolymers, polyester resins, and the like. The mixers used for coating include sample mill, HENSCHEL mill, V blender, hybridizer, and the like.

In addition, particles of metals, metal oxides, metal salts, ceramics, resins, carbon black, and the like may be added additionally for improvement of electrostatic properties, conductivity, powder flowability, lubricity, and the like.

The volume-average particle size of the toner according to the invention is preferably in the range of 3 to 9 μm and more preferably 3 to 8 μm. Toners having a volume-average diameter of less than 3 μm may be insufficient in electrostatic properties, resulting in deterioration of printing efficiency, while those of more than 9 μm may result in deterioration in image resolution.

In regard to the particle size distribution index of the toner, it is preferable that the volume-average particle size distribution index GSDv is 1.35 or less, and/or the ratio GSDv/GSDp of the volume-average particle size distribution index GSDv to the number-average particle size distribution index GSDp is 0.90 or more.

A volume-average particle size distribution index GSDv of more than 1.35 may result in deterioration in image resolution, and a GSDv/GSDp ratio of less than 0.90 may result in decrease in electrostatic properties and cause image defects such as scattering of toner and fogging.

The volume-average particle size and the particle size distribution index are determined as follows: cumulative distribution curves are drawn from the smaller side, by using the volume and the number of toner particles classified according to particle ranges (channel) partitioned based on the particle size distribution, as determined for example by an analyzer such as COULTER COUNTER TAII (manufactured by Beckmann Coulter), and the volume-average and number-average particle sizes at a cumulative count of 16% is designated as D16v and D16p, those at a cumulative count of 50%, D50v and D50p, and those at cumulative count of 84%, D84v and D84p.

Then, the volume-average particle size distribution index GSDv is calculated according to Formula $(D84v/D16v)^{1/2}$, and the number-average particle size distribution index GSDp is calculated according to Formula $(D84p/D16p)^{1/2}$. The measurement is performed after a toner is dispersed in an aqueous electrolyte solution (aqueous isotone solution) and subjected to dispersion with ultrasonic wave for 30 seconds or more.

The shape factor SF1 of the toner according to the invention is preferably $110 \leqq SF1 \leqq 140$, for improvement in printing and transfer efficiency as well as image quality. The shape factor SF1 is calculated according to the following Formula (4):

$$SF1=(ML^2/A)\times(\pi/4)\times 100 \qquad \text{Formula (4)}$$

In Formula (4) above, ML represents the maximum length of each particle, and A represents the projected area of each particle.

Generally, some of the toner particles remain in the transferring process and are removed during image formation. A toner having a shape factor SF1 of less than 110 may be lower in the cleaning efficiency when such a remaining toner is removed with a blade or the like and may consequently cause image defects. On the other hand, a toner having a shape factor SF1 of more than 140 may collapse by collision to the carrier in the developing device when used as a developer. The collapse of the toner particles may result in problems such as increase in the amount of fine powder, contamination of the photosensitive drum surface or the like by the releasing agent component thus exposed on the toner surface and the deterioration in electrostatic properties thereby, and occurrence of fogging due to the fine powder.

The average of the shape factors SF1 is determined by incorporating images of 50 toner particles at a magnification of 250 times in an optical microscope into an image-analyzing instrument (trade name: LUZEX III, manufactured by Nireco Corporation), measuring the maximum length and the projected area of each particle, calculating the SF1 of each particle, and obtaining the average thereof.

(Production of Toner for Developing Electrostatic Images)

The method of producing the toner for developing electrostatic images according to the invention described above is not particularly limited, but preferably a wet granulating method.

Favorable wet granulating methods include known methods such as melt suspension, emulsification aggregation (emulsion polymerization aggregation), and dissolution suspension; and the emulsification aggregation method will be described below because the method is useful in the invention.

The emulsification aggregation method comprises an emulsification step of forming emulsified particles (droplets) by emulsifying the crystalline polyester resin and others described in the section "binder resin" in the invention above, an aggregation step of forming aggregates of the emulsified particles (droplets), and a coalescence step of heating and coalescing the aggregates.

—Emulsification Step—

In the emulsification step, emulsified particles (droplets) of the crystalline polyester resin and others are formed by applying a shear force to a mixed solution of an aqueous medium and a mixture solution containing the resin and as needed a colorant (polymer solution).

Although it is possible then to lower the viscosity of the polymer solution by heating or dissolving the resin in an organic solvent, preferably no organic solvent is used if possible, form the viewpoint of environment pollution. In addition, a dispersant may be used additionally for stabilizing the emulsified particles and increasing the viscosity of the aqueous medium. Hereinafter, such a dispersion of emulsified particles may be referred to as a "resin particle dispersion".

Examples of the dispersants include water-soluble polymers such as polyvinyalcohol, methylcellulose, ethylcellulose, hydroxyethylcellulose, carboxymethylcellulose, sodium polyacrylate, and sodium polymethacrylate; surfactant including anionic surfactants such as sodium dodecylbenzenesulfonate, sodium octadecylsulfate, sodium oleate, sodium laurylate, and potassium stearate, cationic surfactants such as laurylamine acetate, stearylamine acetate, and lauryltrimethylammonium chloride, amphoteric ionic surfactants such as lauryldimethylamine oxide, and nonionic surfactants such as polyoxyethylene alkylether, polyoxyalkylene alkylphenylether, and polyoxyethylene alkylamine; inorganic compounds such as tricalcium phosphate, aluminum hydroxide, calcium sulfate, calcium carbonate, and barium carbonate; and the like.

If an inorganic compound is used as the dispersant, it may be used as it is as a commercially available product, or alternatively, as it is converted to particles thereof in a dispersant for obtaining particles.

The amount of the dispersant used is preferably in the range of 0.01 to 20 parts by mass with respect to 100 parts by mass of the binder resin.

Copolymerization of the crystalline polyester resin with a dicarboxylic acid having a sulfonic acid group (i.e., acid-derived constituent component containing a component derived from the dicarboxylic acid having a sulfonic acid group in a suitable amount) in the emulsification step is effective in reducing the amount of the dispersion stabilizer such as surfactant. However, increase in the amount of the sulfonic acid groups facilitates emulsification but also tends to deteriorate the electrostatic properties of the toner, in particular the electrostatic properties in a high-temperature high-humidity environment; and thus, similarly to the crystalline polyester resin according to the invention, design of a composition containing the sulfonic acid groups in an amount as low as possible is preferable. By using the crystalline polyester resin according to the invention, it is also possible to form emulsified particles without use of a dicarboxylic acid having a sulfonic acid group or the like.

Examples of the organic solvents include ethyl acetate and toluene; and a suitable solvent is selected according to the polyester resin used.

The amount of the organic solvent used is preferably in the range of 50 to 5,000 parts by mass, more preferably 120 to 1,000 parts by mass, with respect to 100 parts by mass of the total amount of the crystalline polyester resin, the amorphous resin, and other monomers used as needed (hereinafter, referred to simply as "polymer").

A colorant may be mixed before forming the emulsified particles. The colorants favorably used are already described in the section "colorant" in the invention. If a crystalline polyester resin having a lower sulfonic acid group content is used, it is possible to form an emulsion with a smaller amount of dispersion stabilizer such as surfactant by raising the pH at the time of emulsification to the alkaline side.

Examples of the emulsifiers used for forming the emulsified particles include homogenizer, homomixer, Cavitron, CLEARMIX, pressurized kneader, extruder, medium dispersing machine, and the like. In regard to the size of the polyester resin emulsified particles (droplets), the average particle size (volume-average particle size) thereof is preferably in the range of 0.01 to 1 μm, more preferably 0.03 to 0.5 μm and still more preferably 0.03 to 0.4 μm.

The method of dispersing the colorant is not particularly limited, and any method, for example, a method of using a rotary shearing homogenizer or a mill using a dispersion medium (ball mill, sand mill, or Dynomill), may be used.

Aqueous dispersions of these colorants may be produced together with a surfactant as needed, or organic solvent dispersions of these colorants with a dispersant. Hereinafter, the dispersion of such a colorant is referred to as a "colored dispersion". Any one of the dispersants used for dispersing the polyester resin above may be used as the surfactant or the dispersant for use in dispersing.

The amount of the colorant added is preferably in the range of 1 to 20 mass %, more preferably 1 to 10 mass %, still more preferably 2 to 10 mass %, and further more preferably, 2 to 7 mass %, with respect to the total amount of the polymers above.

When a colorant is mixed in the emulsification step, the polymer and the colorant can be mixed by blending an organic solvent solution of the polymer with a colorant or an organic solvent dispersion of the colorant.

—Aggregation Step—

First in the aggregation step, the emulsified particles of the amorphous resin and the crystalline polyester resin obtained, a colorant dispersion, and as needed a dispersion of a releasing agent are heated for aggregation at a temperature of the glass transition point of the amorphous resin or less and the melting point of the crystalline polyester resin (and of releasing agent) or less, forming aggregated particles.

The aggregates of the emulsified particles and others are formed by reducing the pH of the emulsion to the acidic side while the mixture is stirred. The pH is preferably in the range of 2 to 6, more preferably, 2.5 to 5, and still more preferably 2.5 to 4. It is also effective to use additionally a coagulant at the time.

A surfactant having a polarity opposite to that of the surfactant used as the dispersant, an inorganic metal salt, or a bivalent or higher metal complex can be used favorably as the coagulant for use. Use of a metal complex, which reduces the amount of the surfactant to be used and thus improves the electrostatic properties, is particularly preferable.

Examples of the inorganic metal salts include metal salts such as calcium chloride, calcium nitrate, barium chloride, magnesium chloride, zinc chloride, and aluminum chloride, aluminum sulfate; and polymeric inorganic metal salts such as polyaluminum chloride, polyaluminum hydroxide, and calcium polysulfide; and the like. Among them, aluminum salts and the polymers thereof are favorable. For obtaining sharper particle size distribution, it is preferable to use higher valent inorganic metal salt, i.e., bivalent better than monovalent, trivalent better than bivalent, and quadrivalent better than trivalent, and to use a polymeric inorganic metal salt if the valencies of the metals are the same.

If aggregated particles are coated as core particles with a resin thereon, emulsified particles of the coating resin are added after the aggregated particles are grown to a desirable particle diameter. In such a case, a coagulant may be added additionally or the pH of the solution adjusted. The added emulsified particles of coating resin are adhered surrounding the aggregated core particle surface. At the time, the diameter and the amount of the emulsified particles of coating resin are adjusted in such a manner that the aggregated core particles are coated sufficiently. In this manner, aggregated particles coated with the emulsified particles of coating resin are produced.

—Coalescence Step—

In the coalescence step, toner particle are prepared by terminating progress of aggregation by raising the pH of the aggregated particle suspension into the range of 3 to 10, stirring the suspension in a similar manner to aggregation step, heating the aggregated particles in the solution obtained after the aggregation step at least to a temperature higher than the lower of the melting point of the crystalline polyester resin contained in the aggregated particles and the glass transition temperature of the amorphous resin (additionally, including the shell layer resin, glass transition temperature of the resin having the lowest glass transition temperature if the resin contains two or more kinds of resins) contained in the aggregated particles, and thus coalescing the aggregated particles.

Specifically, for making the ratio $\Delta H2/\Delta H1$ satisfy the relationship represented by Formula (1) above, by setting the heating temperature higher than both the melting point of the crystalline polyester resin and the glass transition temperature of the amorphous resin, it is possible to decrease $\Delta H1$ by advancing the fusion in the coalescence step and to control the relationship between $\Delta H2$ and $\Delta H1$ relatively. Namely, coalescence at higher temperature raises the ratio $\Delta H2/\Delta H1$, while coalescence at low temperature lowers the ratio $\Delta H2/\Delta H1$. In practice, for more effective coalescence, it is preferable to perform coalescence at a temperature higher by more than 10° C. than the melting point of the crystalline polyester resin or the glass transition temperature of the amorphous resin whichever is higher.

The period of heating is preferably, approximately 0.5 to 10 hours for advancing the coalescence sufficiently and making the ratio $\Delta H2/\Delta H1$ satisfy the relationship above.

When a dicarboxylic acid having a double bond is used as the copolymerization component of the crystalline polyester resin, cross-linking may be conducted by heating the polyester resin to its melting point or higher during the emulsification, aggregation, or coalescence step, or after each step. If cross-inking is conducted, a crosslinked structure is introduced, for example, by using, as the binder resin, an unsaturated crystalline polyester resin containing a double bond component copolymerized and allowing the radical reaction of the resin to proceed. At that time, one of the following polymerization initiator is used favorably.

Examples of the polymerization initiator includes t-butylperoxy-2-ethylhexanoate, cumylperpivalate, t-butylperoxylaurate, benzoylperoxide, lauroylperoxide, octanoylperoxide, di-t-butylperoxide, t-butylcumylperoxide, dicumylperoxide, 2,2'-azobisisobutyronitrile, 2,2'-azobis (2-methylbutyronitrile), 2,2'-azobis (2,4-dimethylvaleronitrile), 2,2'-azobis (4-methoxy-2,4-dimethylvaleronitrile), 1,1-bis (t-butylperoxy) 3,3,5-trimethylcyclohexane, 1,1-bis (t-butylperoxy) cyclohexane, 1,4-bis (t-butylperoxycarbonyl) cyclohexane, 2,2-bis (t-butylperoxy) octane, n-butyl 4,4-bis (t-butylperoxy) valate, 2,2-bis (t-butylperoxy) butane, 1,3-bis (t-butylperoxyisopropyl) benzene, 2,5-dimethyl-2,5-di (t-butylperoxy) hexane, 2, 5-dimethyl-2,5-di (t-butylperoxy) hexane, 2,5-dimethyl-2,5-di (benzoylperoxy) hexane, di-tbutyldiperoxyisophthalate, 2,2-bis (4,4-di-t-butylperoxycyclohexyl) propane, di-t-butylperoxy-□-methylsuccinate, di-t-butylperoxydimethylglutarate, di-t-butylperoxyhexahydroterephthalate, di-t-butylperoxyazelate, 2,5-dimethyl-2,5-di (t-butylperoxy) hexane, diethylene glycol-bis (t-butylperoxycarbonate), di-t-butylperoxytrimethyladipate, tris (t-butylperoxy) triazine, vinyltris (t-butylperoxy) silane, 2,2'-azobis (2-methylpropionamidinedihydrochloride), 2,2'-azobis [N-(2-carboxyethyl)-2-methylpropionamidine], 4,4'-azobis (4-cyanovaleric acid), and the like.

These polymerization initiators can be used alone or in a combination of two or more. An amount and a type of the polymerization initiator is selected in accordance with an amount of unsaturated region in the polymer, and type and amount of a coexisting colorant.

The polymerization initiator may be mixed in advance with the polymer before the emulsifying process or may be introduced into the aggregate during the aggregation process. Further, the polymerization initiator may be introduced during the coalescence process or after the coalescence process. When the polymerization initiator is introduced during the aggregation process, during the coalescence process, or after the coalescence process, a solution in which the polymerization initiator is dissolved or emulsified is added to a particle dispersion (resin particles dispersion or the like). For the purpose of controlling the degree of polymerization, a known crosslinking agent, a chain transfer agent, a polymerization inhibitor, or the like may be added to the polymerization initiator.

The coalesced particles after coalescence are then separated in a solid liquid separation step, for example, by filtration, and then washed and dried as needed, to give toner particles. For ensuring sufficiently superior electrostatic properties and reliability of the toner, the fused particles are preferably washed thoroughly.

Any one of drying methods commonly practiced including vibrationally fluidized bed drying, spray drying, freeze drying, and flash jet drying may be used in the drying step. The toner particles are preferably controlled to a water content of 1.0% or less, more preferably 0.5% or less by mass after drying.

<Electrostatic Image Developer>

An electrostatic image developer of the invention include the toner for developing electrostatic images according to the invention thus obtained. The toner for developing electrostatic images according to the invention may be used as a one-component developer or as the toner in two-component developers containing a carrier and a toner. Hereinafter, the two-component developer, as an embodiment of the electrostatic image developer according to the invention, will be described.

A carrier which can be used for the above two-component developer is not limited in particular and any known carrier can be used. Examples of the carrier include a resin coat carrier which has a resin-coated layer on the surface of a core material. Further, the carrier may be a dispersed-type resin coat carrier in which a conductive material is dispersed in a matrix resin.

Examples of the coating resin/matrix resin used for the carrier include polyethylene, polypropylene, polystyrene, polyvinyl acetate, polyvinyl alcohol, polyvinyl butyral, polyvinyl chloride, polyvinyl ether, polyvinyl ketone, a vinyl chloride/vinyl acetate copolymer, a styrene/acrylic acid copolymer, a straight silicone resin formed by organosiloxane bonds or a modified product thereof, fluorine contained resins, polyester, polycarbonate, phenol resins, epoxy resins, and the like. However, the coating resin/matrix resin is not limited to the same.

Examples of the conductive material include metals (such as gold, silver, copper, or the like), carbon black, titanium oxide, zinc oxides, barium sulfate, aluminum borate, potassium titanate, tin oxide, and the like. However, the conductive material is not limited to the same.

Further, examples of the core material of the carrier include magnetic metals (such as iron, nickel, cobalt, or the like), magnetic oxides (such as ferrite, magnetite, or the like), glass beads, and the like. In order to use the carrier with a magnetic brushing method, the core material is preferably a magnetic material.

The volume average particle size of the core material of the carrier is preferably from 10 to 500 μm and more preferably from 30 to 100 μm.

Moreover, in order to resin-coat the surface of the core material of the carrier, there is a method of coating by a coated layer-forming solution, in which the above coating resin and various additives, as necessary, are dissolved in an appropriate solvent. The solvent is not limited in particular and may be selected appropriately in consideration of the coating resin to be used, application suitability, and the like.

Specific examples of the concrete resin coating methods include a submerging method in which the core material of the carrier is submerged in the coated layer-forming solution, a spray method in which the coated layer-forming solution is sprayed on the surface of the core material of the carrier, a fluid bed method in which the coated layer-forming solution is sprayed in a state in which the core material of the carrier is floated by an flow, and a kneader coater method in which the core material of the carrier and the coated layer-forming solution are mixed in a kneader coater and then the solvent is removed.

The mixing ratio (mass ratio) in the above two-component developer between the electrophotographic toner of the present invention and the above-described carrier is preferably within a range of the order of 1:100 to 30:100 and more preferably within a range of the order of 3:100 to 20:100.

<Image-Forming Method>

The image-forming method according to the invention is an image-forming method, comprising a latent image forming step of forming an electrostatic image on a latent image-holding member surface, a developing step of developing the electrostatic image formed on the latent image-holding member surface with a developer containing a toner to form a toner image, a transferring step of transferring the toner image formed on the latent image-holding member surface onto a transfer material surface, and a fixing step of heat-fixing the toner image transferred on the transfer material surface, wherein the toner for developing electrostatic images according to the invention is used as the toner.

The developer may be a one-component or two-component developer. Any one of known steps in the image-forming method may be used as each step above. The image-forming method according to the invention may include other steps in addition to the steps above.

For example, an electrophotography photoreceptor or a dielectric recording body may be used as the latent image-holding member. In the case of electrophotography photoreceptor, an electrostatic image is formed on the surface of the electrophotography photoreceptor by electrostatically charging the surface uniformly with a Corotron charger, a contact charger, or the like, and irradiating light thereon (latent image forming step). Then, a toner image is formed on the electrophotography photoreceptor by adhering toner particles to the electrostatic image while bringing a developing roll having a developer layer formed on the surface into contact or close proximity to the image (developing step). The formed toner image is transferred onto the surface of a transfer material such as paper by using, for example, a Corotron charger (transferring step). The toner image transferred on the transfer material surface is then fixed in the fixing unit, giving a final toner image. In the invention, when a toner image is transferred directly from the photoreceptor to paper or the like, the paper (recording material) is the transfer material, but when an intermediate transfer body is used, for example, for full-color image formation, the intermediate transfer body is also included in the transfer material.

Normally, a release oil is fed to the fixing member in the fixing unit during heat fixation in the fixing unit, for prevention of offsetting or the like. In the toners according to the invention (including those contained in two-component developers, the same shall apply hereinafter), the binder resins having a crosslinked structure therein are superior in separability and thus allow fixing without or with a reduced amount of the releasing agent.

The release oil is preferably not used for preventing adhesion of the oil to the transfer material and to the toner image, but reduction of the feed rate of the release oil to 0 $mg/cm^2$ may increase abrasion of the fixing member and thus reduce the durability of the fixing member when the fixing member is brought into contact with an transfer material such as paper during fixing; and thus, the release oil, if necessary, is supplied to the fixing member in an amount preferably in the range of $8.0\times10^{-2}$ $mg/cm^2$ or less.

A release oil feed rate of more than $8.0\times10^{-2}$ $mg/cm^2$ may lead to deterioration in image quality due to the release oil remaining adhered on the image surface after fixing, and such a phenomenon may become distinguishable when a transparent recording material such as an OHP sheet is used. It may also result in stickiness of the transfer material due to a large amount of release oil adhered thereon. Further, increase in the feed rate of release oil is inevitably associated with increase in the capacity of the tank storing the release oil and may become a factor of increase in the size of the fixing unit.

The release oil is not particularly limited, and examples thereof include liquid releasing agents such as dimethylsilicone oils, fluorochemical oils, fluorosilicone oils, modified oils such as amino-modified silicone oils, and the like. Among them, modified oils such as amino-modified silicone oils are superior in the wettability to the fixing member and thus preferable, because the silicone oils can form a uniform release oil layer on the surface of the fixing member. In addition, fluorochemical and fluorosilicone oils are also preferable for forming a uniform release oil layer.

The method of supplying the release oil onto the surface to the roller or belt, fixing member for use in the heat compression, is not particularly limited, and examples thereof include a pad method of using a pad impregnated with a liquid releasing agent, a web method, a roller method, a non-contact shower method (spraying method), and the like, and among them, web and roller methods are preferable. These methods are advantageous in that it is possible to feed the release oil uniformly and to control the feed rate easily.

The feed rate of release oil may be determined as follows: When a plain paper used in common copying machines (e.g., trade name: J Paper, copying paper manufactured by Fuji Xerox Co., Ltd.) is supplied into a fixing member to which a release oil is fed onto the surface, the release oil becomes adhered to the plain paper. The adhered release oil is extracted with a Soxhlet extractor. Hexane is used as the solvent. The amount of the release oil adhered on the plain paper can be determined quantitative by quantifying the amount of the release oil contained in hexane by using an atomic absorption spectrometer. The amount is defined as the feed rate of release oil to fixing member.

Examples of the transfer material (recording material) to which the toner image is transferred include plain papers and OHP sheets commonly used in electrophotographic copying machines, printers, and the like.

The image-forming method according to the invention, which employs the electrostatic image developer according to the invention (the inventive toner), allows low-temperature fixing and assures preservation of a suitable amount of frictional electrostatic charge on the toner. Accordingly, the method is superior in energy conservation, and the toner is resistant to scattering during image formation and provides favorable images at the same time. The surface of the recording material is preferably as smooth as possible for improving the image surface smoothness after fixing, and, for example, use of a plain paper coated with a resin or the like on its surface, an art paper for printing, or the like is preferable.

The image-forming method employing the toner for developing electrostatic images according to the invention eliminates aggregation of the toner, and thus allows formation of high-quality images and low-temperature fixing and provides images superior in storability. Further, when the binder resin has a crosslinked structure, there is almost no adhesion of the release oil onto the recording material; and seals, stickers, and others carrying high-quality high-density images can be prepared by forming images on recording material having an adhesive coated on the rear face such as seals and tapes.

EXAMPLES

Hereinafter, the present invention will be described in more detail with reference to Examples and Comparative Examples, but it should be understood that the invention is not restricted by the following Examples. The "parts" and "%" below means "parts by mass" and "mass %" respectively, unless specified otherwise.

<Methods of Evaluating Various Properties>

First, methods of evaluating the physical properties of the toners and others used in Examples and Comparative Examples are described below.

(Toner Particle Size and Particle Size Distribution)

The particle size and the particle size distribution of the toners according to the invention are determined by using COUNTER COUNTER TA-II (manufactured by Beckmann Coulter), and the electrolyte solution used therein is ISOTON-II (manufactured by Beckmann Coulter).

In measurement, 0.5 to 50 mg of sample is added to 2 ml of an aqueous solution of containing 5% surfactant, preferably sodium alkylbenzenesulfonate, as the dispersant. The mixture is then added to 100 to 150 ml of the electrolyte solution above. The sample-suspended electrolyte is sonicated in an ultrasonic dispersing machine for about 1 minute, and then, the particle diameter distribution of the particles of 2 to 60 μm in diameter is determined in the COUNTER COUNTER TA-II by using an aperture having an aperture size of 100 μm, to give the volume-average particle size, GSDv, and GSDp described above. The number of particles measured is 50,000.

(Shape Factor SF1 of Toner)

The toner shape factor SF1 is determined by incorporating optical microscopic images of toner particles spread on the surface of a slide glass into a Luzex image-analyzing instrument via a video camcorder, measuring the maximum lengths and projected areas of 50 or more toner particles, and obtaining the averages by calculating according to the Formula: (maximum length of toner)$^2$/projected area ($ML^2/A$)×100

(Molecular Weight and Molecular Weight Distribution of Resin)

In the invention, the molecular weight distribution is determined as follows: The GPC apparatus used is HLC-8120 GPC, SC8020 (manufactured by Tosoh Corp.) equipped with two columns (trade name: TSK gel Super HM-H, manufactured by Tosoh Corp., 6.0 mm ID×15 cm), wherein tetrahydrofuran (THF) is used as the eluent. The sample concentration is 0.5%; the flow rate is 0.6 ml/min; the sample injection, 10 μl; the measuring temperature is 40° C.; and an IR detector is used for measurement. The calibration curve is prepared by using 10 polystyrene standard samples, "TSK Standards": "A-500", "F-1", "F-10", "F-80", "F-380", "A-2500", "F-4", "F-40" "F-128", and "F-700", manufactured by Tosoh Corp.

(Volume-Average Particle Sizes of Resin Particles, Colorant Particles and Others)

The volume-average particle sizes of resin particles, colorant particles, and others are determined by using a laser-diffraction particle size distribution-measuring device (LA-700, manufactured by Horiba, Ltd.).

(Melting Point, Glass Transition Temperature and the Endothermic Quantity of Resins and Toners)

The melting points of the toner and the crystalline polyester resin, and the glass transition temperatures of the toner and the amorphous resin, according to the invention are determined according to ASTM D3418-8 from the maximum peaks respectively measured in the temperature profile shown in FIG. 1 (crystalline polyester resin and amorphous resin determined only in the first heating step). The glass transition point is a temperature at the intersection of the baseline and the downward slope in the endothermic region of the DSC curve, while the melting point is a temperature at the point of endothermic peak.

In addition, the endothermic quantities ΔH1 and ΔH2 are determined from the peak areas enclosed by the endothermic peak and the base line in the first and second heating steps. The measurement is performed by using a differential scanning calorimeter (DSC-50, manufactured by Shimadzu Corporation).

(Softening Temperature)

The softening temperature $T_{f1/2}$ is determined as a temperature at the center value of the temperatures between initiation and termination of flow when a 1 cm$^3$ sample is melted and allowed to flow in a flow tester CFT-500 (manufactured by Shimadzu Co.), under the conditions of a dice micropore diameter of 0.5 mm, an applied pressure of 0.98 MPa (10 kg/cm$^2$), and a heating rate of 1° C./min.

<Preparation of Toner>

(Preparation of Amorphous Resin Particle Dispersion)

Into a round-bottomed flask equipped with a stirrer, a nitrogen-supplying tube, a temperature sensor, and a rectification column, added are the polyvalent alcohol and the polyvalent carboxylic acid components in the composition shown in Table 1, and the mixture is heated up to 200° C. by using a mantle heater. Then, the mixture is stirred while the flask is kept under an inert gas atmosphere by supplying a nitrogen gas from the gas-supplying tube. Then, of dibutyltin oxide in an amount of 0.05 parts with respect to 100 parts of the raw material mixture is added thereto, and the mixture is allowed to react for a particular time while keeping the temperature of the reaction product at 200° C., to give an amorphous resin (1) to (5).

Physical properties of the resins are summarized in Table 2.

Then, the amorphous resin obtained is fed as it is in a molten state into an emulsifier (Cavitron CD 1010, manufactured by Eurotec, Ltd.) at a rate of 100 g per minute. Dilute aqueous ammonia water at a concentration of 0.40% prepared by diluting reagent-grade aqueous ammonia water with ion-exchange water, which is stored in a separate aqueous medium tank, is fed into the emulsifier at a speed of 0.1 liter per minute together with the molten polyester resin, while being heated with a heat exchanger to 120° C. The mixture is stirred in the emulsifier in the same state under the conditions of a rotor rotational velocity of 60 Hz and an applied pressure of 0.49 MPa (5 kg/cm$^2$), to give an amorphous resin particle dispersion (1) to (5) (resin particle concentration: 30%) having volume-average particle sizes of 0.15, 0.18, 0.23, 0.24, or 0.21 μm.

TABLE 1

| | | Amorphous resin (1) | Amorphous resin (2) | Amorphous resin (3) | Amorphous resin (4) | Amorphous resin (5) |
|---|---|---|---|---|---|---|
| Alcohol component (part) | BPA-EO | 25 | 30 | 25 | 5 | 35 |
| | BPA-PO | — | — | 25 | 45 | 15 |
| | Ethylene glycol | 25 | 20 | — | — | — |
| Carboxylic acid component (part) | Terephthalic acid | 30 | 35 | 30 | — | 15 |
| | Isophthalic acid | — | — | — | 15 | — |
| | Succinic acid | 20 | 15 | 5 | — | 20 |
| | Fumaric acid | — | — | — | 35 | — |
| | Trimellitic anhydride | — | — | 15 | — | 15 |

BPA-EO: Bisphenol A-ethylene oxide (1 mol adduct)

BPA-PO: Bisphenol A-propylene oxide (1 mol adduct)

TABLE 2

| | Number-average molecular weight (Mn) | Weight-average molecular weight (Mw) | SP value (cal$^{1/2}$ · cm$^{3/2}$) | Glass transition temperature (° C.) | Softening temperature $T_{f1/2}$ (° C.) |
|---|---|---|---|---|---|
| Amorphous resin (1) | 2200 | 7800 | 10.4 | 55 | 77 |
| Amorphous resin (2) | 2900 | 9500 | 10.5 | 58 | 88 |
| Amorphous resin (3) | 3500 | 42000 | 10.2 | 64 | 120 |
| Amorphous resin (4) | 5500 | 58000 | 10.1 | 63 | 137 |
| Amorphous resin (5) | 5500 | 81000 | 10.3 | 68 | 145 |

(Preparation of Crystalline Polyester Resin Particle Dispersion)

—Crystalline Polyester Resin Particle Dispersion (1)—

Azelaic acid 875.1 parts 1,4-butenediol 450.5 parts

Fumaric acid 40.7 parts

Dibutyltin 2.5 parts

The components above are mixed in a flask, heated to 220° C. under reduced pressure, and allowed to react in a dehydration condensation reaction for 6 hours, to give a crystalline polyester resin. The melting point of the resin obtained is 60° C. Then, 80 parts of the crystalline polyester resin and 720 parts of deionized water are placed in a stainless steel beaker and heated to 95° C. in a hot water bath. After the crystalline polyester resin melts, the mixture is agitated at 8,000 rpm in a homogenizer (Ultra-Turrax T50, manufactured by IKA). Then, the mixture is then emulsified and dispersed while adding dropwise 20 parts of an aqueous solution prepared by diluting 1.6 parts of an anionic surfactant (Neogen RK, manufactured by Dai-ichi Kogyo Seiyaku Co., Ltd.) in 18.4 parts of ion-exchange water thereto, to give a crystalline polyester resin particle dispersion (1) containing particles having a volume-average diameter of 0.24 μm (resin particle concentration: 10%, SP value: 9.30 $cal^{1/2}\cdot cm^{3/2}$)

—Crystalline Polyester Resin Particle Dispersion (2)—

Sebacic acid 900.2 parts

Ethylene glycol 450.5 parts

Isophthalic acid-5-sulfonic acid sodium 26.6 parts

Fumaric acid 40.6 parts

Dibutyltin 2.0 parts

The components above are allowed to react in a dehydration condensation under a condition similar to that for preparation of the crystalline polyester resin particle dispersion (1), to give a crystalline polyester resin having a melting point of 70° C. The resin is further subjected to emulsion dispersion under a condition similar to that for preparation of the crystalline polyester resin particle dispersion (1), to give a crystalline polyester resin particle dispersion (2) containing particles having a volume-average diameter of 0.19 μm (resin particle concentration: 10%, SP value: 9.67 $cal^{1/2}\cdot cm^{3/2}$).

—Crystalline Polyester Resin Particle Dispersion (3)—

Succinic acid 679.4 parts 1,4-Butenediol 550.5 parts

Fumaric acid 40.6 parts

Dibutyltin 2.0 parts

The components above are allowed to react in a dehydration condensation under a condition similar to that for preparation of the crystalline polyester resin particle dispersion (1), to give a crystalline polyester resin having a melting point of 95° C. The resin is further subjected to emulsion dispersion under a condition similar to that for preparation of the crystalline polyester resin particle dispersion (1), to give a crystalline polyester resin particle dispersion (3) containing particles having a volume-average diameter of 0.22 μm (resin particle concentration: 10%, SP value: 9.86 $cal^{1/2}\cdot cm^{3/2}$).

(Preparation of Releasing Agent Dispersion)

—Releasing Agent Dispersion (1)—

Polyethylene wax (Polywax725, manufactured by Toyo-Petrolite, melting point: 102° C.) 50 parts Anionic surfactant (Neogen RK, manufactured by Dai-ichi Kogyo Seiyaku Co., Ltd.) 5 parts Ion-exchange water 200 parts The components above are mixed, melted by heating to 110° C., and dispersed in a homogenizer (Ultra-Turrax T50, manufactured by IKA) and additionally in Menton Gaulin high-pressure homogenizer (manufactured by Gaulin), to give a releasing agent dispersion (1) containing the releasing agent having a volume-average particle size of 220 nm (releasing agent concentration: 20%).

—Releasing Agent Dispersion (2)—

Paraffin wax 112 (melting point: 47° C., manufactured by Nippon Seiro) 45 parts

Cationic surfactant (Neogen RK, Dai-ichi Kogyo Seiyaku) 5 parts

Ion-exchange water 200 parts

The components above are mixed, heated to 95° C., and dispersed sufficiently in Ultra-Turrax T50 manufactured by IKA and additionally in a high-pressure extrusion Gaulin homogenizer, to give a releasing agent dispersion (2) containing the releasing agent having a volume-average particle size of 185 nm and a solid matter content of 25%.

—Preparation of Colorant Dispersion—

Cyan pigment (Pigment Blue 15:3 (copper phthalocyanine), manufactured by Dainichiseika Color & Chemicals Mfg.) 1,000 parts Anionic surfactant (Neogen R, manufactured by Dai-ichi Kogyo Seiyaku) 150 parts Ion-exchange water 9,000 parts The components above are mixed, dissolved, and dispersed in a high pressure-impact dispersing machine Ultimizer (HJP30006, manufactured by Sugino Machine Ltd.) for about 1 hour for dispersion of the colorant (cyan pigment), to give a colorant dispersion. The volume-average particle size of the colorant (cyan pigment) in the colorant dispersion is 0.15 μm and the concentration of colorant particle is 23%.

(Preparation of Toner Particle)

The components respectively shown in Table 3 and 1.5 parts of an aqueous 10% polyaluminum chloride solution (manufactured by Asada Chemicals) as the coagulant are added into a round stainless steel flask, and the pH of the mixture is adjusted to pH 2.5 with an aqueous 0.1N nitric acid solution. Then, the mixture is stirred at room temperature for 30 minutes, dispersed in a homogenizer (Ultra-Turrax T50, manufactured by IKA), and heated to 45° C. while stirred and kept at the same temperature for 30 minutes in a heating oil bath. Then, 50 parts of the amorphous resin dispersion is added additionally, and the mixture is heated up to 50° C. and stirred additionally for 1 hour.

Observation of the dispersion obtained under an optical microscope reveals that aggregated particles having a particle size of approximately 7.5 μm are formed. The dispersion is adjusted to pH 7.5 by addition of an aqueous sodium hydroxide solution, heated to 80° C. and kept at the same temperature in a heating oil bath for 2 hours. The dispersion is cooled to room temperature, filtered, washed thoroughly with ion-exchange water, and dried in a vacuum dryer, to give toners particle A to L.

TABLE 3

| | Crystalline polyester dispersion | | Amorphous resin dispersion | | Releasing agent dispersion | | | | |
|---|---|---|---|---|---|---|---|---|---|
| | Kind | Addition amount (parts) | Kind | Addition amount (parts) | Kind | Addition amount (parts) | Kind | Addition amount (parts) | Colorant dispersion added (parts) |
| Toner particle A | (3) | 425 | (2) | 140 | (1) | 50 | (2) | — | 22 |
| Toner particle B | (3) | 255 | (2) | 200 | (1) | 50 | (2) | — | 22 |
| Toner particle C | (2) | 85 | (2) | 255 | (1) | 50 | (2) | — | 22 |
| Toner particle D | (2) | 170 | (3) | 230 | (1) | 50 | (2) | — | 22 |
| Toner particle E | (1) | 255 | (4) | 200 | (1) | 50 | (2) | 25 | 22 |
| Toner particle F | (3) | 425 | (1) | 140 | (1) | 50 | (2) | — | 22 |
| Toner particle G | (3) | 600 | (2) | 85 | (1) | 50 | (2) | — | 22 |
| Toner particle H | (3) | 130 | (2) | 240 | (1) | 50 | (2) | — | 22 |
| Toner particle I | (2) | 40 | (2) | 270 | (1) | 50 | (2) | — | 22 |
| Toner particle J | (3) | 85 | (3) | 255 | (1) | 50 | (2) | — | 22 |
| Toner particle K | (2) | 85 | (4) | 255 | (1) | 50 | (2) | 25 | 22 |
| Toner particle L | (1) | 425 | (5) | 140 | (1) | 50 | (2) | — | 22 |

One part of colloidal silica (R972, manufactured by Nippon Aerosil Co., Ltd.) is added to 100 parts of each of the toner particles thus obtained, and mixed in a HENSCHEL MIXER, to give each of the toners for developing electrostatic images A to L. Properties of the toners are summarized in Table 4.

TABLE 4

| | Volume-average particle size (μm) | GSDv | GSDv/GSDp | SF1 | Tm1 (° C.) | Tg1 (° C.) | ΔH2/ΔH1 | Tg1 − Tg2 (° C.) | $T_{f1/2}$ (° C.) | Relationship between $T_{f1/2}$ and 205 − 1.4 × Tm1 |
|---|---|---|---|---|---|---|---|---|---|---|
| Toner A | 6.2 | 1.22 | 0.95 | 123 | 80 | 53 | 0.75 | 9 | 85 | $T_{f1/2} \leqq 205 - 1.4 \times Tm1$ |
| Toner B | 6.5 | 1.23 | 0.93 | 119 | 69 | 50 | 0.55 | 9 | 83 | $T_{f1/2} \leqq 205 - 1.4 \times Tm1$ |
| Toner C | 7.2 | 1.20 | 0.90 | 116 | 55 | 49 | 0.50 | 11 | 83 | $T_{f1/2} \leqq 205 - 1.4 \times Tm1$ |
| Toner D | 6.8 | 1.25 | 0.98 | 122 | 62 | 60 | 0.80 | 8 | 118 | $T_{f1/2} \leqq 205 - 1.4 \times Tm1$ |
| Toner E | 6.3 | 1.24 | 0.98 | 124 | 55 | 60 | 0.78 | 10 | 134 | $T_{f1/2} \leqq 205 - 1.4 \times Tm1$ |
| Toner F | 5.9 | 1.28 | 0.99 | 119 | 85 | 52 | 0.86 | 7 | 74 | $T_{f1/2} \leqq 205 - 1.4 \times Tm1$ |
| Toner G | 5.5 | 1.23 | 0.91 | 123 | 88 | 56 | 0.97 | 2 | 86 | $T_{f1/2} > 205 - 1.4 \times Tm1$ |
| Toner H | 6.4 | 1.23 | 0.93 | 121 | 61 | 51 | 0.33 | 18 | 84 | $T_{f1/2} \leqq 205 - 1.4 \times Tm1$ |
| Toner I | 6.8 | 1.24 | 0.95 | 118 | 48 | 45 | 0.38 | 12 | 81 | $T_{f1/2} \leqq 205 - 1.4 \times Tm1$ |
| Toner J | 6 | 1.27 | 0.97 | 124 | 54 | 52 | 0.23 | 14 | 116 | $T_{f1/2} \leqq 205 - 1.4 \times Tm1$ |
| Toner K | 6.2 | 1.23 | 0.96 | 127 | 67 | 62 | 0.70 | 8 | 136 | $T_{f1/2} > 205 - 1.4 \times Tm1$ |
| Toner L | 6.8 | 1.24 | 0.97 | 131 | 58 | 66 | 0.97 | 3 | 142 | $T_{f1/2} > 205 - 1.4 \times Tm1$ |

<Preparation of Electrostatic Image Developer>

A coating agent resin solution prepared by mixing and dispersing a carbon dispersion (prepared by mixing 1.25 parts of toluene and 0.12 part of carbon black (trade name; VXC-72, manufactured by Cabot) and dispersing the mixture in a sand mill for 20 minutes) and with 1.25 parts of 80% trifunctional isocyanate ethyl acetate solution (Takenate D110N, manufactured by Takeda Chemical Industries, Ltd.) and Mn—Mg—Sr ferrite particles (volume-average particle size: 35 μm) are added and agitated at room temperature for 5 minutes in a kneader, and then heated to 150° C. under atmospheric pressure for removal of the solvent. After heating additionally for 30 minutes, the mixture is allowed to cool to 50° C. The coated carrier obtained is sieved with a 75-μm mesh screen, to give a carrier. 95 parts of the carrier and 5 parts of each of the toners for developing electrostatic images A to L are mixed in a V blender, to give each of electrostatic image developers A to L.

Example 1

Evaluation of the Storage Stability of Toner

The storage stability of toner is evaluated by measuring powder aggregating tendency (toner blocking resistance). The powder aggregating tendency is determined by using a powder tester (manufactured by Hosokawamicron) equipped with three sieves respectively having openings of 53, 45, and 38 μm from the top, placing 2 g of accurately weighed toner on the 53-μm-opening sieve, vibrating the sieves repeatedly by a width of 1 mm for 90 seconds, determining the mass of the toner on the respective sieves after vibration, and calculating according to the following Formula (5).

Powder aggregating tendency=[(Mass of toner on 53-μ-opening sieve)×0.5+(Mass of toner on 45-μm-opening)×0.3+(Mass of toner on 38-μm-opening sieve)×0.1]×100/(Mass of total toner used)(%) Formula (5)

For evaluation, toners previously left in an environment at 45° C. and 50% RH for about 24 hours are used, and the measurement is performed in an environment of 25° C. and 50% RH. Generally toners having a powder-aggregating tendency of 40% or less can be used without any practical problems. In the invention, the powder-aggregating tendency is evaluated according to the following criteria.

a: ≦20% b: 21% to 30% c: 31% to 40% d: ≧41%

(Evaluation of Fixing in Actual Machine)

The electrostatic image developer A is filled into a developing unit of a modified DOCUPRINT C2220 developing device manufactured by Fuji Xerox Co., Ltd. (modified so that the fixing temperature in the fixing unit is variable), and solid images (toner amount: 4.5 g/m$^2$) and thin line images are printed repeatedly while the surface fixing roll temperature in the fixing unit is raised stepwise from 60 to 200° C. at an interval of 10° C. These images are evaluated as follows:

Breakdown of the fixed image is evaluated by visual observation by folding the paper carrying the fixed solid image almost at the center of the image, and the lowest fixing temperature (MTF (° C.)) giving an image at a level without any image breakdown is determined. Separately, hot offsetting is also evaluated by visual observation, and the difference between the MTF and the hot offsetting temperature, i.e., the possible fixing temperature range U (° C.), is evaluated according to the following criteria.

—Low-Temperature Fixing Efficiency— a: MTF≦110° C. Excellent in low-temperature fixing efficiency b: 110° C.<MTF≦120° C. Fair in low-temperature fixing efficiency c: 120° C.<MTF lower in low-temperature fixing efficiency —Possible Fixing Temperature Range— a: U≧60° C. Practically usable in a wider temperature range b: 60° C.>U≧20° C. Practically without problems c: 20° C.>U Practically unusable (Evaluation of Image Storage Stability)

Evaluation of the image storage stability is performed by laying two recording papers carrying the image fixed at the lowest fixing temperature with their images facing each other, leaving the layered recording papers in an environment at a temperature of 60° C. and a humidity of 85% under a load of $9.8\times10^3$ Pa (100 g/cm$^2$) for 7 days and then visually observing whether there is fusion of the images between the recording papers and transfer of the image into the nonimage region when the layered papers are separated, and the results are classified according to the following evaluation criteria.

a: No problem in image storability b: Practically no problem although there is some change observable c: Practically unusable due to significant change observable Results are summarized in Table 5.

Examples 2 to 5

Evaluation is performed in a similar manner to Example 1, except that the toners and the electrostatic image developers shown in Table 5 are used replacing the toner A and the electrostatic image developer A of Example 1.

Results are Summarized in Table 5.

Comparative Examples 1 to 7

Evaluation is performed in a similar manner to Example 1, except that the toners and the electrostatic image developers shown in Table 5 are used replacing the toner A and the electrostatic image developer A of Example 1.

Results are summarized in Table 5.

TABLE 5

| | Toner (developer) | Powder aggregating tendency | Lowest fixing temperature | Desirable fusion temperature range | Image storage stability |
|---|---|---|---|---|---|
| Example 1 | A | a | a (90° C.) | a (60° C.) | a |
| Example 2 | B | a | a (100° C.) | a (70° C.) | a |
| Example 3 | C | b | a (90° C.) | a (60° C.) | a |
| Example 4 | D | b | a (110° C.) | a (80° C.) | a |
| Example 5 | E | b | a (90° C.) | a (90° C.) | a |
| Comparative Example 1 | F | b | b (120° C.) | c (20° C.) | c |
| Comparative Example 2 | G | b | c (130° C.) | c (10° C.) | b |
| Comparative Example 3 | H | b | a (110° C.) | b (40° C.) | c |
| Comparative Example 4 | I | d | a (90° C.) | c (10° C.) | c |
| Comparative Example 5 | J | d | a (100° C.) | a (70° C.) | c |
| Comparative Example 6 | K | b | c (130° C.) | b (40° C.) | a |
| Comparative Example 7 | L | c | c (140° C.) | b (30° C.) | b |

As apparent from the results shown in Tables 4 and 5, the toners in Examples 1 to 5 are superior in storage stability of both toner and image after fixation, and have a favorable low-temperature fixing efficiency and a wider possible fixing temperature range, but when Tm1 is high as in Comparative Examples 1 and 2, low-temperature fixing efficiency is prevented. The toner in Comparative Example 4 has a better low-temperature fixing efficiency, but has a problem in storage stability of powder, as its Tm1 is low.

In addition, as shown in Comparative Examples 2, 6, and 7, low temperature fixing efficiency of the toners is prevented independent of Tm1 when the softening temperature of the amorphous resin deviates from the range of the relationship represented by Formula (2) above. The result is the same when the recrystallization rate is higher in Comparative Example 2.

On the other hand, as shown in Comparative Examples 3 and 5, a decrease in the recrystallization rate results in images fixed in the plasticized state, causing problems in image storage stability.

Thus, according to the invention, by using a crystalline polyester resin and an amorphous resin and having the thermal properties of the toner derived from these resins controlled within a particular range, it is possible to provide a toner for developing electrostatic images having an excellent low-temperature fixing efficiency and a wider possible fixing temperature range that is superior in storage stability as powder as well as an image after fixation, and an electrostatic image developer and an image-forming method using the same.

What is claimed is:

1. A toner for developing electrostatic images, comprising a binder resin and a colorant, the binder resin comprising a crystalline polyester resin and an amorphous resin, wherein:

when, in differential scanning calorimetry of the toner according to ASTM D3418-8, the temperature of an endothermic peak derived from the crystalline polyester resin in a first heating process is defined as Tm1 (° C.), an endothermic quantity based on the endothermic peak in the first heating process is defined as ΔH1 (mW/g), and an endothermic quantity based on an endothermic peak in a second heating process is defined as ΔH2 (mW/g), Tm1 is 50 to 80° C., and ΔH1 and ΔH2 satisfy the relationship represented by the following Formula (1);

when the softening temperature of the toner is defined as $T_{f1/2}$(° C.), $T_{f1/2}$ is 85 to 135° C.;

Tm1 and $T_{f1/2}$ satisfy the relationship represented by the following Formula (2):

$$0.35 \leqq \Delta H2/\Delta H1 + 0.95 \quad \text{Formula (1)}$$

$$T_{f1/2} \leqq 205 - (1.4 \times Tm1) \quad \text{Formula (2);}$$

when the crystalline polyester resin has an ester concentration M represented by the following Formula (3) of 0.01 to 0.12:

$$M = K/A \quad \text{Formula (3);}$$

where K represents the number of ester groups in the crystalline polyester resin and A represents the number of atoms constituting a polymer chain of the crystalline polyester resin;

the crystalline polyester resin includes an acid-derived constituent component derived from an aliphatic dicarboxylic acid and an alcohol-derived constituent component derived from an aliphatic diol; and an amount of content of the acid-derived constituent derived from the aliphatic dicarboxylic acid, among all other acid-derived components, is 80-100 mole % by constitution.

2. The toner for developing electrostatic images according to claim 1, wherein when the glass transition temperature in the first heating process is defined as Tg1 (° C.) and the glass transition temperature in the second heating process is defined as Tg2 (° C.), the difference (Tg1−Tg2) is 5 to 15° C.

3. The toner for developing electrostatic images according to claim 1, wherein the glass transition temperature Tg1 (° C.) in the first heating process is in the range of 45 to 70° C.

4. The toner for developing electrostatic images according to claim 1, wherein $T_{f1/2}$ is 85 to 125° C.

5. The toner for developing electrostatic images according to claim 1, wherein the melting point of the crystalline polyester resin is 60 to 120° C.

6. The toner for developing electrostatic images according to claim 1, wherein the glass transition temperature of the amorphous resin is 45 to 65° C.

7. The toner for developing electrostatic images according to claim 1, wherein the mass ratio (A/B) of the amount of the crystalline polyester resin (A) to the amount of amorphous resin (B) in the binder resin is 2/98 to 50/50.

8. The toner for developing electrostatic images according to claim 1, further comprising two or more releasing agents.

9. The toner for developing electrostatic images according to claim 1, wherein the volume-average particle size of the toner is 3 to 9 μm.

10. The toner for developing electrostatic images according to claim 1, wherein the volume-average particle size distribution index GSDv is 1.35 or less.

11. The toner for developing electrostatic images according to claim 1, wherein the ratio GSDv/GSDp of the volume-average particle distribution index GSDv to the number-average particle size distribution index GSDp is 0.90 or more.

12. The toner for developing electrostatic images according to claim 1, prepared by a wet granulating method.

13. The toner for developing electrostatic images according to claim 12, wherein the wet granulating method is an emulsion polymerization aggregation method.

14. The toner for developing electrostatic images according to claim 1, wherein core particles containing the binder resin are coated with a coating resin on the surface thereof.

15. An electrostatic image developer, comprising the toner for developing electrostatic images according to claim 1.

16. An image-forming method, comprising forming an electrostatic image on a latent image-holding member surface, developing the electrostatic image formed on the latent image-holding member surface with a developer containing a toner to form a toner image, transferring the toner image onto a transfer material surface, and heat-fixing the toner image transferred on the transfer material surface; wherein the toner used is the toner for developing electrostatic images according to claim 1.

* * * * *